US010032536B2

(12) United States Patent
Ito et al.

(10) Patent No.: US 10,032,536 B2
(45) Date of Patent: Jul. 24, 2018

(54) COPPER ALLOY FOR ELECTRONIC DEVICE, METHOD FOR PRODUCING COPPER ALLOY FOR ELECTRONIC DEVICE, AND COPPER ALLOY ROLLED MATERIAL FOR ELECTRONIC DEVICE

(71) Applicant: MITSUBISHI MATERIALS CORPORATION, Tokyo (JP)

(72) Inventors: Yuki Ito, Okegawa (JP); Kazunari Maki, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 681 days.

(21) Appl. No.: 14/291,335

(22) Filed: May 30, 2014

(65) Prior Publication Data

US 2014/0271339 A1 Sep. 18, 2014

Related U.S. Application Data

(62) Division of application No. 13/695,666, filed as application No. PCT/JP2011/061036 on May 13, 2011.

(30) Foreign Application Priority Data

May 14, 2010 (JP) ..... 2010-112265
May 14, 2010 (JP) ..... 2010-112266

(51) Int. Cl.
*H01B 1/02* (2006.01)
*C22F 1/08* (2006.01)
(Continued)

(52) U.S. Cl.
CPC ..... *H01B 1/026* (2013.01); *C22C 1/02* (2013.01); *C22C 1/03* (2013.01); *C22C 9/04* (2013.01); *C22F 1/08* (2013.01)

(58) Field of Classification Search
CPC .. C22F 1/08; H01B 1/026; C22C 9/00; C22C 9/04; C22C 1/02; C22C 1/03
See application file for complete search history.

(56) References Cited

U.S. PATENT DOCUMENTS 4,337,793 A 7/1982 Sato et al.
4,732,731 A 3/1988 Asai et al.
(Continued)

FOREIGN PATENT DOCUMENTS

CN 101707084 A 5/2010
CN 102206766 A 10/2011
(Continued)

OTHER PUBLICATIONS

Miyato et al., JP 02111834, published Apr. 1990. Machine translation.*

(Continued)

*Primary Examiner* — Keith Walker
*Assistant Examiner* — John A Hevey
(74) *Attorney, Agent, or Firm* — Locke Lord LLP

(57) ABSTRACT

One aspect of this copper alloy for an electronic device is composed of a binary alloy of Cu and Mg which includes Mg at a content of 3.3 to 6.9 atomic %, with a remainder being Cu and inevitable impurities, and a conductivity σ (% IACS) is within the following range when the content of Mg is given as A atomic %, $\sigma \leq \{1.7241/(-0.0347 \times A^2 + 0.6569 \times A + 1.7)\} \times 100$. Another aspect of this copper alloy is composed of a ternary alloy of Cu, Mg, and Zn which includes Mg at a content of 3.3 to 6.9 atomic % and Zn at a content of 0.1 to 10 atomic %, with a remainder being Cu and inevitable impurities, and a conductivity σ (% IACS) is within the following range when the content of Mg is given as A atomic % and the content of Zn is given as B atomic %, (Continued)

$\sigma \leq \{1.7241/(X+Y+1.7)\} \times 100$, $X=-0.0347 \times A^2+0.6569 \times A$ and $Y=-0.0041 \times B^2+0.2503 \times B$.

3 Claims, 6 Drawing Sheets

(51) Int. Cl.

| | |
|---|---|
| ***C22C 9/04*** | (2006.01) |
| ***C22C 1/02*** | (2006.01) |
| ***C22C 1/03*** | (2006.01) |

(56) References Cited

U.S. PATENT DOCUMENTS

| | | | | |
|---|---|---|---|---|
| 2006/0239853 | A1 | 10/2006 | Maehara et al. | |
| 2006/0275618 | A1 | 12/2006 | Kugimiya et al. | |
| 2008/0298998 | A1* | 12/2008 | Kaneko | C22C 9/06 420/472 |
| 2012/0267013 | A1 | 10/2012 | Kaneko et al. | |
| 2014/0283961 | A1 | 9/2014 | Maki et al. | |
| 2014/0283962 | A1 | 9/2014 | Ito et al. | |
| 2014/0290805 | A1 | 10/2014 | Maki et al. | |
| 2016/0160321 | A1* | 6/2016 | Ito | C22C 9/00 439/887 |

FOREIGN PATENT DOCUMENTS

| | | | | |
|---|---|---|---|---|
| CN | 103842551 | A | 6/2014 | |
| DE | 3628783 | A1 | 10/1987 | |
| EP | 2319947 | A1 | 5/2011 | |
| JP | 53-125222 | A | 11/1978 | |
| JP | 62-250136 | A | 10/1987 | |
| JP | 63-310929 | A | 12/1988 | |
| JP | 64-052034 | A | 2/1989 | |
| JP | 01-107943 | A | 4/1989 | |
| JP | 01-309219 | A | 12/1989 | |
| JP | 02-111834 | A | 4/1990 | |
| JP | 02111834 | * | 4/1990 | C22C 9/00 |
| JP | 02-145737 | A | 6/1990 | |
| JP | 03-80858 | B2 | 12/1991 | |
| JP | 04-268033 | A | 9/1992 | |
| JP | 05-082203 | A | 4/1993 | |
| JP | 07-018354 | A | 1/1995 | |
| JP | 07-019788 | A | 1/1995 | |
| JP | 07-166271 | A | 6/1995 | |
| JP | 10-219372 | A | 8/1998 | |
| JP | 11-036055 | A | 2/1999 | |
| JP | 11-186273 | A | 7/1999 | |
| JP | 11-199954 | A | 7/1999 | |
| JP | 2001-152303 | A | 6/2001 | |
| JP | 2002-180165 | A | 6/2002 | |
| JP | 2005-113259 | A | 4/2005 | |
| JP | 2010-053445 | A | 3/2010 | |
| JP | 2010-188362 | A | 9/2010 | |
| JP | 2011-102416 | A | 5/2011 | |
| JP | 2011-241412 | A | 12/2011 | |
| JP | 2012-251226 | A | 12/2012 | |
| JP | 2013-100571 | A | 5/2013 | |
| JP | 2013-104095 | A | 5/2013 | |
| KR | 20140048335 | A | 4/2014 | |
| WO | WO-2006/000307 | A2 | 1/2006 | |
| WO | 2011/068135 | A1 | 6/2011 | |
| WO | WO-2011/104982 | A1 | 9/2011 | |

OTHER PUBLICATIONS

Office Action dated Jan. 14, 2016, issued for the Taiwanese patent application No. 101139714 and English translation thereof.

Office Action dated Jan. 14, 2016, issued for the Taiwanese patent application No. 101141343 and English translation thereof.

Notice of Allowance dated Oct. 29, 2015, issued for the Chinese patent application No. 201280049749.4 and English translation thereof.

Supplementary European Search Report dated Jun. 6, 2014, issued for the European patent application No. 11780706.5, PCT/JP2011061036.

Koya Nomura, "Technical Trends in High Performance Copper Alloy Strip for Connector and Kobe Steel's Development Strategy," Kobe Steel Engineering Reports, vol. 54. No. 1 (2004), pp. 2 to 8 and English abstract thereof.

Shigenori Hori and other two researchers, "Grain Boundary Precipitation in Cu—Mg alloy," Journal of the Japan Copper and Brass Research Association, vol. 19 (1980), pp. 115 to 124 and English abstract thereof.

International Search Report dated Aug. 16, 2011, issued for PCT/JP2011/061036.

Office Action dated Feb. 14, 2012, issued for the Japanese Patent Application No. 2010-112265.

International Search Report dated Jan. 29, 2013, issued for PCT/JP2012/077736.

International Search Report dated Feb. 12, 2013, issued for PCT/JP2012/078851.

International Search Report dated Feb. 12, 2013, issued for PCT/JP2012/078688.

Office Action dated Nov. 29, 2013, issued for the Singapore patent application No. 201207897-8.

Office Action dated Dec. 4, 2013, issued for the Chinese patent application No. 201180018491.7 and English translation of Search Report.

Supplementary European Search Report dated Jun. 5, 2015, issued for the European Patent Application No. 12847293.3.

Office Action dated Aug. 18, 2015, issued for the Japanese patent application No. 2011-248731 and partial English translation thereof.

G.T. Murray et al., "Preparation and Characterization of Pure Metals," Properties and Selection: Nonferrous Alloys and Special-Purpose Materials, vol. 2, ASM Handbook, ASM International, 1990, pp. 1093-1097(print), 13 pages in total (online).

Office Action dated Apr. 3, 2015, issued for the Chinese patent application No. 201280047170.4 and English translation thereof.

Supplementary European Search Report dated Apr. 16, 2015, issued for the European patent application No. 12843355.4, PCT/JP2012077736.

Office Action dated Apr. 16, 2015, issued for the Chinese patent application No. 201280047171.9 and English translation thereof.

Supplementary European Search Report dated Apr. 16, 2015, issued for the European patent application No. 12849153.7, PCT/JP2012078688.

Ampcoloy 90-Corrosion-Resistant High-Conductivity Casting Copper, Alloy Digest, Mar. 1981, 2 sheets.

Derek E. Tyler et al., "Introduction to Copper and Copper Alloys," ASM Handbook, vol. 2: Properties and Selection: Nonferrous Alloys and Special-Purpose Materials, 1990, pp. 216-233.

"ASM Speciality Handbook—Copper and Its Alloys", ISBN: 0-87170-726-8; published Aug. 2001; p. 15.

"Copper and Its Alloys", E.G. West, ISBN: 0-85312-505-8; published 1982, p. 129.

Office Action: Summons to Attend Oral Proceedings; EP application No. 12843355.4, dated Nov. 4, 2016.

Office Action: Summons to Attend Oral Proceedings; EP application No. 12849153.7, dated Nov. 4, 2016.

Decision for Grant of Patent dated Feb. 22, 2017 issued for corresponding Korean Patent Application No. 10-2014-7009375.

Office Action for U.S. Appl. No. 13/695,666, dated Mar. 8, 2017.

Office Action dated May 15, 2018, issued for U.S. Appl. No. 14/353,924.

* cited by examiner (a)

(b)

(a)

(b)

(a)

(b)

(a)

(b)

COPPER ALLOY FOR ELECTRONIC DEVICE, METHOD FOR PRODUCING COPPER ALLOY FOR ELECTRONIC DEVICE, AND COPPER ALLOY ROLLED MATERIAL FOR ELECTRONIC DEVICE

This application is a divisional application of U.S. application Ser. No. 13/695,666, filed Nov. 1, 2012 which claims the right of priority under 35 U.S.C. § 119 based on Japanese Patent Application Nos. 2010-112265 and 2010-112266 both filed May 14, 2010.

TECHNICAL FIELD

The present invention relates to a copper alloy for an electronic device, which is appropriate for electronic and electrical components such as terminals, connectors, relays, and the like, a method for producing the copper alloy for an electronic device, and a rolled copper alloy for an electronic device.

The present application claims priority on Japanese Patent Application No. 2010-112265 filed on May 14, 2010 and Japanese Patent Application No. 2010-112266 filed on May 14, 2010, the contents of which are incorporated herein by reference.

BACKGROUND ART

Conventionally, in accordance with a decrease in the sizes of electronic devices, electrical devices, and the like, efforts have been made to decrease the sizes and the thicknesses of electronic and electrical components such as terminals, connectors, relays, and the like that are used in the electronic devices, the electrical devices, and the like. Therefore, there is a demand for a copper alloy that is excellent in spring properties, a strength, and a conductivity as a material which constitutes the electronic and electrical components. Particularly, as described in Non-Patent Document 1, it is preferable for the copper alloy that is used in electronic and electrical components such as terminals, connectors, relays, and the like to have a high proof stress and a low Young's modulus.

As a copper alloy that is excellent in spring properties, a strength, and a conductivity, a Cu—Be alloy containing Be is provided in, for example, Patent Document 1. This Cu—Be alloy is a precipitation-hardened alloy with a high strength, and CuBe is age-precipitated in a matrix phase; and thereby, the strength is improved without decreasing the conductivity.

However, the Cu—Be alloy contains an expensive element of Be; and therefore, the cost of raw materials is extremely high. In addition, when the Cu—Be alloy is manufactured, toxic beryllium oxides are generated. Therefore, in the manufacturing process, it is necessary to provide a special configuration of manufacturing facilities and strictly manage the beryllium oxides in order to prevent the beryllium oxides from being accidentally leaked outside. As described above, the Cu—Be alloy had problems in that the cost of raw materials and the manufacturing cost were both high, and the Cu—Be alloy was extremely expensive. In addition, as described above, since a detrimental element of Be was included, the use of the Cu—Be alloy was avoided in terms of environmental protection.

For example, Patent Document 2 proposes a Cu—Ni—Si-based alloy (so called Corson alloy) as a substitute material that replaces the Cu—Be alloy. This Corson alloy is a precipitation-hardened alloy in which $Ni_2Si$ precipitates are dispersed, and the Corson alloy has a relatively high conductivity and a strength, and also has stress relaxation property. Therefore, the Corson alloy is frequently used for terminals for automobiles, small terminals for signal systems, and the like, and development thereof is actively performed.

In addition, as other alloys, a Cu—Mg alloy disclosed in Non-Patent Document 2, a Cu—Mg—Zn—B alloy disclosed in Patent Document 3, and the like have been developed.

With regard to the Cu—Mg-based alloy, as can be seen from a phase diagram of Cu—Mg system shown in FIG. 1, in the case where the content of Mg is 3.3 atomic % or more, intermetallic compounds including Cu and Mg can be precipitated by performing a solution treatment (from 500° C. to 900° C.) and a precipitation treatment. That is, even in the Cu—Mg-based alloy, a relatively high conductivity and a strength can be obtained through precipitation hardening as is the case with the above-described Corson alloy.

However, in the Corson alloy disclosed in Patent Document 2, the Young's modulus is relatively high, that is, 125 GPa to 135 GPa. With regard to a connector having a structure in which a male tab pushes up a spring contact portion of a female terminal and is inserted into the female terminal, in the case where the Young's modulus of a material that constitutes the connector is high, there is a concern that a variation in contact pressure during the insertion becomes large, and the contact pressure easily exceeds an elastic limit; and thereby, plastic deformation occurs. Therefore, it is not favorable.

In addition, in the Cu—Mg-based alloys disclosed in Non-Patent Document 2 and Patent Document 3, similarly to the Corson alloy, the intermetallic compounds are precipitated. Therefore, there is a tendency that the Young's modulus becomes high, and thus as described above, it is not favorable as a connector.

Furthermore, since coarse metallic compounds are dispersed in a matrix phase, the intermetallic compounds serve as a starting point of cracking during a bending process, and thus the cracking occurs easily. Therefore, there is a problem in that it is difficult to form a connector having a complicated shape.

PRIOR ART DOCUMENT

Patent Document

Patent Document 1: Japanese Unexamined Patent Application, First Publication No. H04-268033

Patent Document 2: Japanese Unexamined Patent Application, First Publication No. H11-036055

Patent Document 3: Japanese Unexamined Patent Application, First Publication No. H07-018354

Non-Patent Document

Non-Patent Document 1: Koya Nomura, "Technical Trends in High Performance Copper Alloy Strip for Connector and Kobe Steel's Development Strategy" Kobe steel Engineering Reports, Vol. 54. No. 1 (2004), P. 2 to 8

Non-Patent Document 2: Shigenori Hon and other two researchers, "Grain Boundary Precipitation in Cu—Mg alloy", Journal of the Japan Copper and Brass Research Association, Vol. 19 (1980), p. 115 to 124

DISCLOSURE OF THE INVENTION

Problems to be Solved by the Invention

The present invention was made in consideration of the above-described circumstances, and the present invention aims to provide a copper alloy for an electronic device that has a low Young's modulus, a high proof stress, a high conductivity, and excellent bending formability that is suitable for electronic and electrical components such as terminals, connectors, relays, and the like, a method for producing the copper alloy for an electronic device, and a rolled copper alloy for an electronic device.

Means for Solving the Problems

In order to solve the problems, the present inventors made a thorough investigation, and as a result, they found that a work hardening type Cu—Mg supersaturated solid solution alloy has a low Young's modulus, a high proof stress, a high conductivity, and excellent bending formability, and the work hardening type copper alloy is produced by subjecting a Cu—Mg alloy to a solution treatment (solutionizing) and a subsequent rapid cooling.

Similarly, they also found that a work hardening type Cu—Mg—Zn supersaturated solid solution alloy has a low Young's modulus, a high proof stress, a high conductivity, and excellent bending formability, and the work hardening type copper alloy is produced by subjecting a Cu—Mg—Zn alloy to a solution treatment and a subsequent rapid cooling.

The present invention has characteristics described below on the basis of the findings.

There is provided a first aspect of the copper alloy for an electronic device of the present invention that is composed of a binary alloy of Cu and Mg. The binary alloy contains Mg at a content in a range of 3.3 to 6.9 atomic %, with a remainder being Cu and inevitable impurities, and a conductivity σ (% IACS) is within the following range when the content of Mg is given as A atomic %.

$$\sigma \leq \{1.7241/(-0.0347 \times A^2 + 0.6569 \times A + 1.7)\} \times 100$$

There is provided a second aspect of the copper alloy for an electronic device of the present invention that is composed of a binary alloy of Cu and Mg. The binary alloy contains Mg at a content in a range of 3.3 to 6.9 atomic %, with a remainder being Cu and inevitable impurities, and an average number of intermetallic compounds having grain sizes of 0.1 μm or more is in a range of $1/\mu m^2$ or less.

There is provided a third aspect of the copper alloy for an electronic device of the present invention that is composed of a binary alloy of Cu and Mg. The binary alloy contains Mg at a content in a range of 3.3 to 6.9 atomic %, with a remainder being Cu and inevitable impurities, a conductivity σ (% IACS) is within the following range when the content of Mg is given as A atomic %, and an average number of intermetallic compounds having grain sizes of 0.1 μm or more is in a range of $1/\mu m^2$ or less.

$$\sigma \leq \{1.7241/(-0.0347 \times A^2 + 0.6569 \times A + 1.7)\} \times 100$$

Since the first aspect of the copper alloy for an electronic device has the above-described characteristics, the copper alloy is a Cu—Mg solid solution alloy supersaturated with Mg.

Since the second aspect of the copper alloy for an electronic device has the above-described characteristics, precipitation of an intermetallic compounds is suppressed, and the copper alloy is a Cu—Mg solid solution alloy supersaturated with Mg.

Since the third aspect of the copper alloy for an electronic device has the above-described characteristics of both of the first and second aspects, the copper alloy is a Cu—Mg solid solution alloy supersaturated with Mg.

With regard to the copper alloys consisting of these Cu—Mg supersaturated solid solutions, there is a tendency that a Young's modulus becomes low. Therefore, for example, in the case where the copper alloy is applied to a connector in which a male tab pushes up a spring contact portion of a female terminal and is inserted into the female terminal, or the like, a variation in a contact pressure during the insertion is suppressed. Furthermore, since an elastic limit is high, there is no concern that plastic deformation occurs easily. Therefore, the first to third aspects of the copper alloys for an electronic device are particularly suitable for electronic and electrical components such as terminals, connectors, relays, and the like.

In addition, since Mg is dissolved (solid-solubilized) in a supersaturated manner, a large amount of coarse intermetallic compounds, which serve as a starting point of cracking, are not dispersed in the matrix phase; and therefore, excellent bending formability is obtained. Accordingly, it is possible to mold electronic and electrical components having complicated shapes such as terminals, connectors, relays, and the like by using any one of the first to third aspects of the copper alloys for an electronic device.

Since Mg is dissolved in a supersaturated manner, a strength can be improved by work hardening.

Furthermore, the copper alloy is composed of a binary alloy of Cu and Mg, and the binary alloy contains Cu, Mg, and inevitable impurities. Therefore, a decrease in conductivity due to other elements is suppressed; and thereby, the conductivity becomes relatively high.

Meanwhile, the average number of intermetallic compounds having grain sizes of 0.1 μm or more is calculated by performing observation of 10 visual fields using a field emission scanning electron microscope under conditions where a magnification is 50,000-fold magnification and a visual field is approximately 4.8 $\mu m^2$.

The grain size of the intermetallic compound is an average value of a long diameter and a short diameter of the intermetallic compound. Here, the long diameter is the length of the longest straight line in a grain which does not come into contact with a grain boundary on the way, and the short diameter is the length of the longest straight line in a direction orthogonal to the long diameter which does not come into contact with the grain boundary on the way.

In the first to third aspects of the copper alloys for an electronic device, a Young's modulus E may be in a range of 125 GPa or less, and a 0.2% proof stress $\sigma_{0.2}$ may be in a range of 400 MPa or more.

In this case, a resilience modulus ($\sigma_{0.2}^2/2E$) becomes high, and thus, plastic deformation does not occur easily. Therefore, the copper alloy is particularly suitable for electronic and electrical components such as terminals, connectors, relays, and the like.

A first aspect of a method for producing a copper alloy for an electronic device of the present invention is a method for producing any one of the first to third aspects of the copper alloys for an electronic device. The first aspect of the method for producing the copper alloy for an electronic device includes: a heating process of heating a copper material composed of a binary alloy of Cu and Mg to a temperature of 500 to 900° C.; a rapid cooling process of cooling the heated copper material at a cooling rate of 200° C./min or more to a temperature of 200° C. or lower; and a working process of working the rapidly cooled copper material. The binary alloy contains Mg at a content in a range of 3.3 to 6.9 atomic %, with a remainder being Cu and inevitable impurities.

According to the first aspect of the method for producing the copper alloy for an electronic device, Mg can be solutionized by the conditions of the above-described heating process. In the case where the heating temperature is lower than 500° C., there is a concern that the solutionizing becomes incomplete; and thereby, a large amount of the intermetallic compounds may remain in the matrix phase. In the case where the heating temperature exceeds 900° C., there is a concern that a part of the copper material becomes a liquid phase; and thereby, a structure or a surface state becomes uneven. Therefore, the heating temperature is set to be in a range of 500 to 900° C.

The precipitation of the intermetallic compounds during the cooling can be suppressed by the conditions of the rapid cooling process; and thereby, the copper material can be a Cu—Mg supersaturated solid solution.

Improvement in strength due to work hardening can be achieved by the working process. A working method is not particularly limited. For example, rolling is employed in the case where the final form is a sheet or a strip. Wire drawing or extrusion is employed in the case where the final form is a line or a rod. Forging or pressing is employed in the case where the final form is a bulk shape. A working temperature is not particularly limited; however, it is preferable to set the temperature to be in a range of −200 to 200° C. which is in a cold or warm state in order to prevent the occurrence of precipitation. A reduction ratio is appropriately selected so as to obtain a shape close to the final form; however, in the case where work hardening is considered, the reduction ratio is preferably in a range of 20% or more, and more preferably in a range of 30% or more.

Meanwhile, a so-called low-temperature annealing may be performed after the working process. Due to this low-temperature annealing, a further improvement in mechanical characteristics can be achieved.

A first aspect of a rolled copper alloy for an electronic device of the present invention is composed of any one of the above-described first to third aspects of the copper alloys for an electronic device, in which a Young's modulus E is in a range of 125 GPa or less, and a 0.2% proof stress $\sigma_{0.2}$ is in a range of 400 MPa or more. According to the first aspect of the rolled copper alloy for an electronic device, a resilience modulus ($\sigma_{0.2}{}^2/2E$) is high; and therefore, plastic deformation does not occur easily.

The first aspect of the rolled copper alloy for an electronic device may be used as a copper material that constitutes a terminal, a connector, or a relay.

A fourth aspect of the copper alloy for an electronic device of the present invention is composed of a ternary alloy of Cu, Mg, and Zn. The ternary alloy contains Mg at a content in a range of 3.3 to 6.9 atomic % and Zn at a content in a range of 0.1 to 10 atomic %, with a remainder being Cu and inevitable impurities, and a conductivity σ (% IACS) is within the following range when the content of Mg is given as A atomic % and the content of Zn is given as B atomic %.

$$\sigma \leq \{1.7241/(X+Y+1.7)\} \times 100$$

$$X = -0.0347 \times A^2 + 0.6569 \times A$$

$$Y = -0.0041 \times B^2 + 0.2503 \times B$$

A fifth aspect of the copper alloy for an electronic device of the present invention is composed of a ternary alloy of Cu, Mg, and Zn. The ternary alloy contains Mg at a content in a range of 3.3 to 6.9 atomic % and Zn at a content in a range of 0.1 to 10 atomic %, with a remainder being Cu and inevitable impurities, and an average number of intermetallic compounds having grain sizes of 0.1 μm or more is in a range of $1/\mu m^2$ or less.

A sixth aspect of the copper alloy for an electronic device of the present invention is composed of a ternary alloy of Cu, Mg, and Zn. The ternary alloy contains Mg at a content in a range of 3.3 to 6.9 atomic % and Zn at a content in a range of 0.1 to 10 atomic %, with a remainder being Cu and inevitable impurities, a conductivity σ (% IACS) is within the following range when the content of Mg is given as A atomic % and the content of Zn is given as B atomic %, and an average number of intermetallic compounds having grain sizes of 0.1 μm or more is in a range of $1/\mu m^2$ or less.

$$\sigma \leq \{1.7241/(X+Y+1.7)\} \times 100$$

$$X = -0.0347 \times A^2 + 0.6569 \times A$$

$$Y = -0.0041 \times B^2 + 0.2503 \times B$$

Since the forth aspect of the copper alloy for an electronic device has the above-described characteristics, the copper alloy is a Cu—Mg—Zn solid solution alloy supersaturated with Mg.

Since the fifth aspect of the copper alloy for an electronic device has the above-described characteristics, precipitation of an intermetallic compounds is suppressed, and the copper alloy is a Cu—Mg—Zn solid solution alloy supersaturated with Mg.

Since the sixth aspect of the copper alloy for an electronic device has characteristics of both of the fourth and fifth aspects, the copper alloy is a Cu—Mg—Zn solid solution alloy supersaturated with Mg.

With regard to the copper alloys consisting of these Cu—Mg—Zn supersaturated solid solutions, there is a tendency that a Young's modulus becomes low. Therefore, for example, in the case where the copper alloy is applied to a connector in which a male tab pushes up a spring contact portion of a female terminal and is inserted into the female terminal, or the like, a variation in a contact pressure during the insertion is suppressed. Furthermore, since an elastic limit is high, there is no concern that plastic deformation occurs easily. Therefore, the fourth to sixth aspects of the copper alloys for an electronic device are particularly suitable for electronic and electrical components such as terminals, connectors, relays, and the like.

In addition, since Mg is dissolved in a supersaturated manner, a large amount of coarse intermetallic compounds, which serve as a starting point of cracking, are not dispersed in the matrix phase; and therefore, excellent bending formability is obtained. Accordingly, it is possible to mold electronic and electrical components having complicated shapes such as terminals, connectors, relays, and the like by using any one of the fourth to sixth aspects of the copper alloys for an electronic device.

Since Mg is dissolved in a supersaturated manner, a strength can be improved by work hardening.

In the case where Zn is dissolved in a copper alloy in which Mg is dissolved, a strength can be greatly improved without increasing a Young's modulus.

Furthermore, the copper alloy is composed of a ternary alloy of Cu, Mg, and Zn, and the ternary alloy contains Cu, Mg, Zn, and inevitable impurities. Therefore, a decrease in conductivity due to other elements is suppressed; and thereby, the conductivity becomes relatively high.

Meanwhile, the average number of intermetallic compounds having grain sizes of 0.1 μm or more is calculated by performing observation of 10 visual fields using a field emission scanning electron microscope under conditions where a magnification is 50,000-fold magnification and a visual field is approximately 4.8 $\mu m^2$.

The grain size of the intermetallic compound is an average value of a long diameter and a short diameter of the intermetallic compound. Meanwhile, the long diameter is the length of the longest straight line in a grain which does not come into contact with a grain boundary on the way, and the short diameter is the length of the longest straight line in a direction orthogonal to the long diameter which does not come into contact with the grain boundary on the way.

In the fourth to sixth aspects of the copper alloys for an electronic device, a Young's modulus E may be in a range of 125 GPa or less, and a 0.2% proof stress $\sigma_{0.2}$ may be in a range of 400 MPa or more.

In this case, a resilience modulus ($\sigma_{0.2}^2/2E$) becomes high, and thus, plastic deformation does not occur easily. Therefore, the copper alloy is particularly suitable for electronic and electrical components such as terminals, connectors, relays, and the like.

A second aspect of a method for producing a copper alloy for an electronic device of the present invention is a method for producing any one of the fourth to sixth aspects of the copper alloys for an electronic device. The second aspect of the method for producing the copper alloy for an electronic device includes: a heating process of heating a copper material composed of a ternary alloy of Cu, Mg, and Zn to a temperature of 500 to 900° C.; a rapid cooling process of cooling the heated copper material at a cooling rate of 200° C./min or more to a temperature of 200° C. or lower; and a working process of working the rapidly cooled copper material. The ternary alloy contains Mg at a content in a range of 3.3 to 6.9 atomic % and Zn at a content in a range of 0.1 to 10 atomic %, with a remainder being Cu and inevitable impurities.

According to the second aspect of the method for producing the copper alloy for an electronic device, Mg and Zn can be solutionized by the conditions of the above-described heating process. In the case where the heating temperature is lower than 500° C., there is a concern that the solutionizing becomes incomplete; and thereby, a large amount of the intermetallic compounds may remain in the matrix phase. In the case where the heating temperature exceeds 900° C., there is a concern that a part of the copper material becomes a liquid phase; and thereby, a structure or a surface state becomes uneven. Therefore, the heating temperature is set to be in a range of 500 to 900° C.

The precipitation of the intermetallic compounds during the cooling can be suppressed by the conditions of the rapid cooling process; and thereby, the copper material can be a Cu—Mg—Zn supersaturated solid solution.

Improvement in strength due to work hardening can be achieved by the working process. A working method is not particularly limited. For example, rolling is employed in the case where the final form is a sheet or a strip. Wire drawing or extrusion is employed in the case where the final form is a line or a rod. Forging or pressing is employed in the case where the final form is a bulk shape. A working temperature is not particularly limited; however, it is preferable to set the temperature to be in a range of −200 to 200° C. which is in a cold or warm state in order to prevent the occurrence of precipitation. A reduction ratio is appropriately selected so as to obtain a shape close to the final form; however, in the case where work hardening is considered, the reduction ratio is preferably in a range of 20% or more, and more preferably in a range of 30% or more.

Meanwhile, a so-called low-temperature annealing may be performed after the working process. Due to this low-temperature annealing, a further improvement in mechanical characteristics can be achieved.

A second aspect of a rolled copper alloy for an electronic device of the present invention is composed of any one of the above-described fourth to sixth aspects of the copper alloys for an electronic device, in which a Young's modulus E is in a range of 125 GPa or less, and a 0.2% proof stress $\sigma_{0.2}$ is in a range of 400 MPa or more.

According to the second aspect of the rolled copper alloy for an electronic device, a resilience modulus ($\sigma_{0.2}^2/2E$) is high; and therefore, plastic deformation does not occur easily.

The second aspect of the rolled copper alloy for an electronic device may be used as a copper material that constitutes a terminal, a connector, or a relay.

Effects of the Invention

According to the aspects of the present invention, it is possible to provide a copper alloy for an electronic device, a method for producing the copper alloy for an electronic device, and a rolled copper alloy for an electronic device. The copper alloy has a low Young's modulus, a high proof stress, a high conductivity, and excellent bending formability and the copper alloy is suitable for electronic and electrical components such as terminals, connectors, relays, and the like.

BEST MODE FOR CARRYING OUT THE INVENTION

Figure 1:
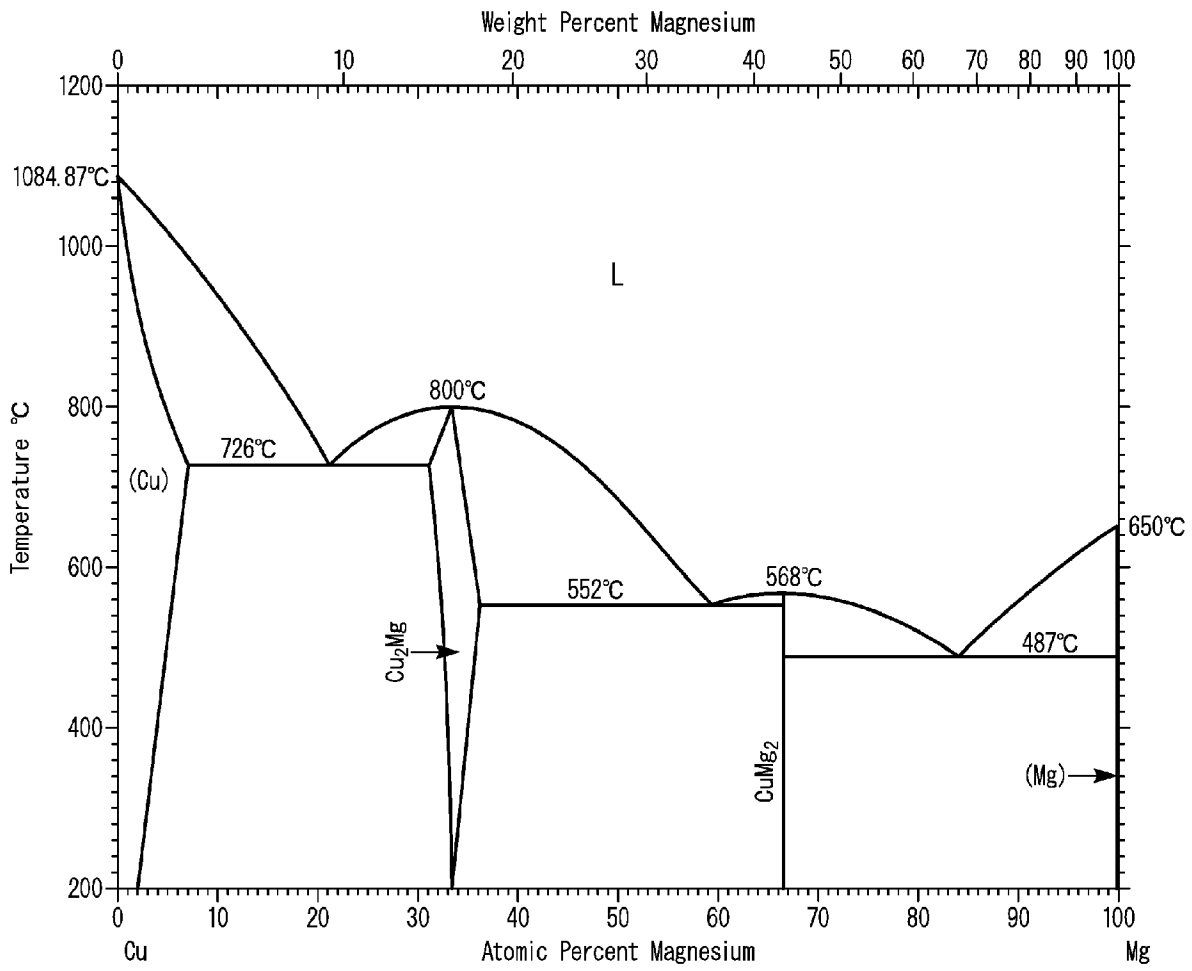
FIG. 1 shows a phase diagram of Cu—Mg system.

Hereinafter, a copper alloy for an electronic device according to an embodiment of the invention will be described.

First Embodiment

A copper alloy for an electronic device according to this embodiment is composed of a binary alloy of Cu and Mg.

The binary alloy contains Mg at a content in a range of 3.3 to 6.9 atomic %, with a remainder being Cu and inevitable impurities.

A conductivity σ (% IACS) is within the following range when the content of Mg is given as A atomic %.

$$\sigma \leq \{1.7241/(-0.0347 \times A^2 + 0.6569 \times A + 1.7)\} \times 100$$

An average number of intermetallic compounds having grain sizes of 0.1 μm or more is in a range of $1/\mu m^2$ or less, and the average number is measured by observation using a scanning electron microscope.

A Young's modulus E of the copper alloy for an electronic device is in a range of 125 GPa or less, and a 0.2% proof stress $\sigma_{0.2}$ is in a range of 400 MPa or more.

(Composition)

Mg is an element having effects of improving a strength and raising a recrystallization temperature without greatly decreasing a conductivity. In addition, when Mg is dissolved in a matrix phase, the Young's modulus is suppressed to be a low level, and excellent bending formability is obtained.

Here, in the case where the content of Mg is less than 3.3 atomic %, the effect is not be obtained sufficiently. On the other hand, in the case where the content of Mg exceeds 6.9 atomic %, intermetallic compounds containing Cu and Mg as a main component remain when a heat treatment for the solutionizing is performed. Therefore, there is a concern that cracking occurs during a subsequent working or the like.

From these reasons, the content of Mg is set to be in a range of 3.3 to 6.9 atomic %.

In the case where the content of Mg is small, the strength may not be improved sufficiently, and the Young's modulus may not be suppressed to be a sufficiently low level. In addition, Mg is an active element. Therefore, in the case where an excess amount of Mg is contained, Mg oxides that are generated by reactions with oxygen during melting and casting may be included (may be mixed into the copper alloy). Accordingly, it is more preferable that the content of Mg is set to be in a range of 3.7 to 6.3 atomic %.

Examples of the inevitable impurities include Sn, Fe, Co, Al, Ag, Mn, B, P, Ca, Sr, Ba, rare-earth elements, Zr, Hf, V, Nb, Ta, Cr, Mo, W, Re, Ru, Os, Se, Te, Rh, Ir, Pd, Pt, Au, Cd, Ga, In, Li, Si, Ge, As, Sb, Ti, Tl, Pb, Bi, S, O, C, Ni, Be, N, H, Hg, and the like.

The rare-earth element is one or more selected from a group consisting of Sc, Y, La, Ce, Pr, Nd, Pm, Sm, Eu, Gd, Tb, Dy, Ho, Er, Tm, Yb, and Lu.

It is preferable that a total content of these inevitable impurities is in a range of 0.3% by mass or less.

(Conductivity σ)

In the binary alloy of Cu and Mg, when the content of Mg is given as A atomic %, the conductivity σ (% IACS) is within the following range.

$$\sigma \leq \{1.7241/(-0.0347 \times A^2 + 0.6569 \times A + 1.7)\} \times 100$$

In this case, the intermetallic compounds containing Cu and Mg as a main component are rarely present.

That is, in the case where the conductivity σ exceeds the right side value of the above-described expression, a large amount of intermetallic compounds containing Cu and Mg as a main component are present, and furthermore, the sizes thereof are large. Therefore, the bending formability is greatly deteriorated. In addition, the intermetallic compounds containing Cu and Mg as a main component are generated, and an amount of dissolved Mg is small. Therefore, the Young's modulus is also increased. Accordingly, production conditions are adjusted in order for the conductivity σ to be within the range of the above-described expression.

In order to reliably obtain the above-described effects, it is preferable that the conductivity σ (% IACS) is within the following range.

$$\sigma \leq \{1.7241/(-0.0292 \times A^2 + 0.6797 \times A + 1.7)\} \times 100$$

In this case, the amount of the intermetallic compounds containing Cu and Mg as a main component becomes smaller; and therefore, the bending formability is further improved.

(Microstructure)

In the copper alloy for an electronic device according to this embodiment, an average number of intermetallic compounds having grain sizes of 0.1 μm or more is in a range of $1/\mu m^2$ or less, and the average number is measured by observation using a scanning electron microscope. That is, the intermetallic compounds containing Cu and Mg as a main component are rarely precipitated, and Mg is dissolved in a matrix phase.

In the case where solutionizing is incomplete or the intermetallic compounds are precipitated after the solutionizing, a large amount of intermetallic compounds having large sizes are present. These intermetallic compounds serve as a starting point of cracking. Therefore, with regard to a copper alloy in which a large amount of intermetallic compounds having large sizes are present, cracking occurs during working, or the bending formability is greatly deteriorated. In addition, in the case where the amount of the intermetallic compounds containing Cu and Mg as a main component is large, the Young's modulus is increased, and thus this is unfavorable.

As a result of examining a microstructure, in the case where the average number of intermetallic compounds having grain sizes of 0.1 μm or more is in a range of $1/\mu m^2$ or less, that is, in the case where the intermetallic compounds containing Cu and Mg as a main component are not present or the amount of the intermetallic compounds is small, a desirable bending formability and a low Young's modulus are obtained.

In order to reliably obtain the above-described effects, it is more preferable that an average number of intermetallic compounds having grain sizes of 0.05 μm or more is in a range of $1/\mu m^2$ or less.

The average number of the intermetallic compounds is measured by the following method. Observation of 10 visual fields is conducted using a field emission scanning electron microscope under conditions in which a magnification is 50,000-fold magnification and a visual field is approximately 4.8 $\mu m^2$, and the number (number (count)/$\mu m^2$) of intermetallic compounds in each visual field is measured. Then, the average value thereof is calculated.

The grain size of the intermetallic compound is an average value of a long diameter and a short diameter of the intermetallic compound. Here, the long diameter is the length of the longest straight line in a grain which does not come into contact with a grain boundary on the way, and the short diameter is the length of the longest straight line in a direction orthogonal to the long diameter which does not come into contact with the grain boundary on the way.

Next, a method for producing the copper alloy for an electronic device according to this embodiment, which has the above-described characteristics, will be described with reference to a flow diagram shown in FIG. 2.

(Melting and Casting Process S01)

First, a copper raw material is melted to obtain a molten copper, and the above-described elements are added to the molten copper so as to adjust components; and thereby, a molten copper alloy is produced. Here, a single element of Mg, a Cu—Mg master alloy, and the like can be used as a raw material of Mg. In addition, a raw material containing Mg may be melted together with the copper raw material. In addition, a recycled material and a scrapped material of the copper alloy of this embodiment may be used.

Here, it is preferable that the molten copper consists of copper having purity of 99.99% by mass or more, that is, so-called 4N Cu. In addition, in the melting process, it is preferable to use a vacuum furnace, or an atmosphere furnace of which atmosphere is an inert gas atmosphere or a reducing atmosphere so as to suppress oxidization of Mg.

Then, the molten copper alloy of which the components are adjusted is casted into a mold so as to produce ingots (copper material). In the case where mass production is taken into account, it is preferable to apply a continuous casting method or a semi-continuous casting method.

(Heating Process S02)

Next, heat treatment is performed for homogenization and solutionizing (solution treatment) of the obtained ingot (copper material). During the progress of solidification, Mg segregates and concentrates; and thereby, intermetallic compounds and the like are generated. In the interior of the ingot, these intermetallic compounds and the like are present. Therefore, in order to eliminate or reduce the segregation of Mg and in order to eliminate or reduce the intermetallic compounds and the like, the ingot is subjected to the heat treatment to heat the ingot to a temperature of 500 to 900° C. Thereby, Mg is evenly dispersed, and Mg is dissolved in the matrix phase in the ingot. In addition, it is preferable that the heating process S02 is performed in a non-oxidization atmosphere or a reducing atmosphere.

(Rapid Cooling Process S03)

Then, the ingot, which is heated to a temperature of 500 to 900° C. in the heating process S02, is cooled at a cooling rate of 200° C./min or more to a temperature of 200° C. or lower. Due to this rapid cooling process S03, precipitation of Mg, which is dissolved in a matrix phase, as intermetallic compounds is suppressed. As a result, it is possible to obtain a copper alloy in which an average number of intermetallic compounds having grain sizes of 0.1 μm or more is in a range of $1/\mu m^2$ or less.

Here, in order to increase the efficiency of rough working and the uniformity of the microstructure, a hot working may be performed after the above-described heating process S02 and the above-described rapid process S03 may be performed after this hot working. In this case, a working method is not particularly limited. For example, rolling can be employed in the case where the final form is a sheet or a strip. Wire drawing, extrusion, groove rolling, or the like can be employed in the case where the final form is a line or a rod. Forging or pressing is employed in the case where the final form is a bulk shape.

(Working Process S04)

The ingot after being subjected to the heating process S02 and the rapid cooling process S03 is cut as necessary. In addition, surface milling of the ingot is performed as necessary in order to remove an oxide film or the like that is generated by the heating process S02, the rapid cooling process S03, and the like. Then, the ingot is worked (processed) in order to have a predetermined shape.

Here, the working method is not particularly limited. For example, rolling can be employed in the case where the final form is a sheet or a strip. Wire drawing, extrusion, or groove rolling can be employed in the case where the final form is a line or a rod. In addition, forging or pressing can be employed in the case where the final form is a bulk shape.

Here, a temperature condition in the working process S04 is not particularly limited; however, it is preferable to set the temperature to be in a range of −200 to 200° C. which is in a cold or warm working state. In addition, a reduction ratio is appropriately selected so as to obtain a shape close to the final form. In order to improve a strength due to work hardening, it is preferable to set the reduction ratio to be in a range of 20% or more. In addition, in order to further improve the strength, it is more preferable to set the reduction ratio to be in a range of 30% or more.

Figure 2:
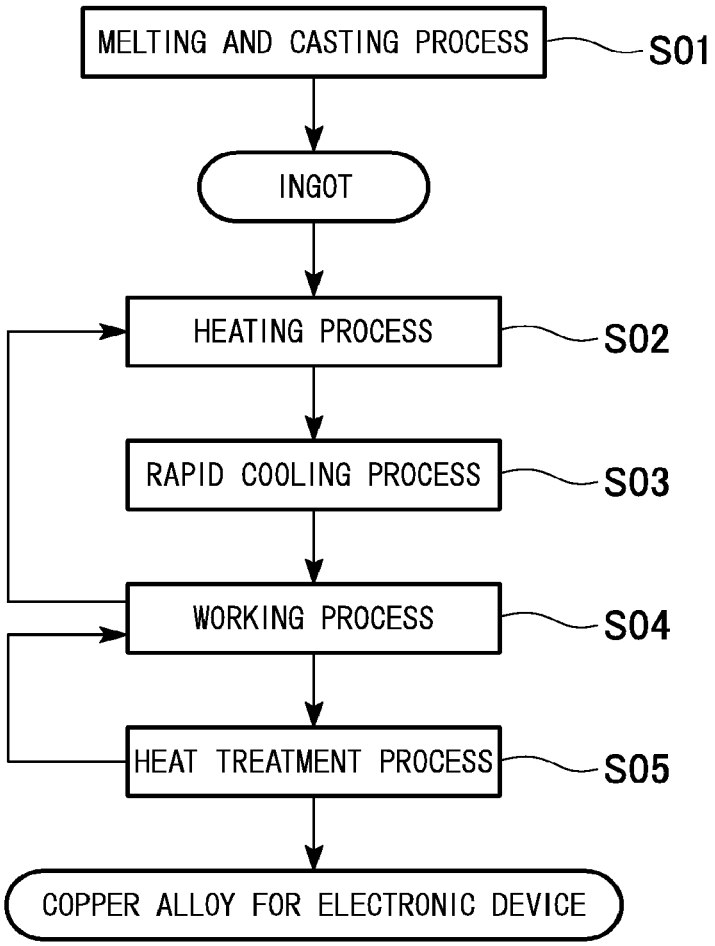
FIG. 2 shows a flow diagram of a method of producing a copper alloy for an electronic device according to an embodiment.

As shown in FIG. 2, the above-described heating process S02, rapid cooling process S03, and the working process S04 may be repetitively performed. Here, after one cycle is completed, the repeated heating process S02 is performed for the purpose of thoroughly conducting solutionizing (solution treatment), obtaining recrystallized structure, or softening for improvement in workability. In addition, instead of the ingot, a worked material becomes an object (copper material).

(Heat Treatment Process S05)

Next, it is preferable to subject the worked material that is obtained by the working process S04 to a heat treatment in order to perform low-temperature anneal hardening or in order to remove residual strain. Conditions of this heat treatment are appropriately adjusted according to characteristics that are required for a product (copper alloy) to be produced.

Here, in this heat treatment process S05, it is necessary to adjust the conditions of the heat treatment (a temperature, a time, and a cooling rate) in order to suppress the precipitating of dissolved Mg. For example, this heat treatment process is preferably performed at 200° C. for approximately one minute to one hour, or at 300° C. for approximately one second to one minute. The cooling rate is preferably set to be in a range of 200° C./min or more.

In addition, the method of the heat treatment is not particularly limited; however, it is preferable to perform a heat treatment at a temperature of 100 to 500° C. for 0.1 second to 24 hours in a non-oxidization atmosphere or in a reducing atmosphere. In addition, a cooling method is not particularly limited; however, it is preferable to employ a method in which a cooling rate becomes in a range of 200° C./min or more, such as a water quenching.

Furthermore, the above-described working process S04 and heat treatment process S05 may be repetitively performed.

In this way, the copper alloy for an electronic device of this embodiment is produced. Here, in the working process S04, in the case where rolling is employed as a working method, a copper alloy for an electronic device is produced which has the final form of a sheet or strip. This copper alloy for an electronic device is called as a rolled copper alloy.

The produced copper alloy for an electronic device of this embodiment has a Young's module E of 125 GPa or less, and a 0.2% proof stress $\sigma_{0.2}$ of 400 MPa or more.

In addition, when the content of Mg is given as A atomic %, a conductivity σ (% IACS) thereof is within the following range.

$$\sigma \leq \{1.7241/(-0.0347\times A^2+0.6569\times A+1.7)\}\times 100$$

The produced copper alloy for an electronic device of this embodiment is composed of a binary alloy of Cu and Mg, and the copper alloy contains Mg at a content in a range of 3.3 to 6.9 atomic % which is a solid-solution limit or more. In addition, an average number of intermetallic compounds having grain sizes of 0.1 μm or more is in a range of $1/\mu m^2$ or less.

That is, the copper alloy for an electronic device of this embodiment is composed of a Cu—Mg solid solution alloy supersaturated with Mg.

In the copper alloy composed of this Cu—Mg supersaturated solid solution, there is a tendency that a Young's modulus becomes low. Therefore, for example, in the case where the copper alloy for an electronic device of this embodiment is applied to a connector in which a male tab pushes up a spring contact portion of a female terminal and is inserted into the female terminal, or the like, a variation in a contact pressure during the insertion is suppressed. Furthermore, since an elastic limit is high, there is no concern that plastic deformation occurs easily. Therefore, the copper alloy for an electronic device of this embodiment is particularly suitable for electronic and electrical components such as terminals, connectors, relays, and the like.

In addition, since Mg is dissolved in a supersaturated manner, a large amount of coarse intermetallic compounds, which serve as a starting point of cracking during bending working, are not dispersed in the matrix phase. Therefore, bending formability is improved. As a result, it is possible to mold electronic and electrical components having a complicated shape such as terminals, connectors, relays, and the like.

Since Mg is dissolved in a supersaturated manner, a strength is improved by work hardening. Therefore, it is possible to obtain a relatively high strength.

The copper alloy is composed of a binary alloy of Cu and Mg, and the binary alloy contains Cu, Mg, and inevitable impurities. Therefore, a decrease in conductivity due to other elements is suppressed; and thereby, it is possible to obtain a relatively high conductivity.

In the copper alloy for an electronic device of this embodiment, the Young's modulus E is in a range of 125 GPa or less, and the 0.2% proof stress $\sigma_{0.2}$ is in a range of 400 MPa or more. Therefore, a resilience modulus ($\sigma_{0.2}^2/2E$) becomes high. Accordingly, plastic deformation does not occur easily. As a result, the copper alloy is particularly suitable for electronic and electrical components such as terminals, connectors, relays, and the like.

According to the method for producing a copper alloy for an electronic device of this embodiment, the ingot or the worked material is composed of the binary alloy of Cu and Mg having the above-described composition, and the ingot or the worked material is heated to a temperature of 500 to 900° C. in the heating process S02. The solutionizing (solution treatment) of Mg can be performed by the heating process S02.

In the rapid cooling process S03, the ingot or the worked material, which is heated by the heating process S02, is cooled at a cooling rate of 200° C./min or more to a temperature of 200° C. or lower. The precipitation of intermetallic compounds during the cooling process can be suppressed due to the rapid cooling process S03. Therefore, the ingot or the worked material after the rapid cooling can be a Cu—Mg supersaturated solid solution.

In the working process S04, the rapidly cooled material (Cu—Mg supersaturated solid solution) is subjected to working. Improvement of a strength due to work hardening can be achieved by the working process S04.

In addition, in the case where the heat treatment process S05 is performed after the working process S04 in order to perform low-temperature anneal hardening or in order to remove residual strains, further improvement in mechanical characteristics can be achieved.

As described above, according to this embodiment, it is possible to provide a copper alloy for an electronic device, which has a low Young's modulus, a high proof stress, a high conductivity, and excellent bending formability, and which is suitable for electronic and electrical components such as terminals, connectors, relays, and the like.

Second Embodiment

A copper alloy for an electronic device of this embodiment is composed of a ternary alloy of Cu, Mg, and Zn. The ternary alloy contains Mg at a content in a range of 3.3 to 6.9 atomic %, and Zn at a content in a range of 0.1 to 10 atomic %, with a remainder being Cu and inevitable impurities.

When the content of Mg is given as A atomic % and the content of Zn is given as B atomic %, a conductivity σ (% IACS) is within the following range.

$$\sigma \leq \{1.7241/(X+Y+1.7)\} \times 100$$

$$X = -0.0347 \times A^2 + 0.6569 \times A$$

$$Y = -0.0041 \times B^2 + 0.2503 \times B$$

An average number of intermetallic compounds having grain sizes of 0.1 μm or more in a range of $1/\mu m^2$ or less, and the average number is measured by observation using a scanning electron microscope.

A Young's modulus E of the copper alloy for an electronic device is in a range of 125 GPa or less, and a 0.2% proof stress $\sigma_{0.2}$ is in a range of 400 MPa or more.

(Composition)

Mg is an element having effects of improving a strength and raising a recrystallization temperature without greatly decreasing a conductivity. In addition, when Mg is dissolved in a matrix phase, the Young's modulus is suppressed to be a low level, and excellent bending formability is obtained.

Here, in the case where the content of Mg is less than 3.3 atomic %, the effect is not be obtained sufficiently. On the other hand, in the case where the content of Mg exceeds 6.9 atomic %, intermetallic compounds containing Cu and Mg as a main component remain when a heat treatment for the solutionizing is performed. Therefore, there is a concern that cracking occurs during a subsequent working or the like.

From these reasons, the content of Mg is set to be in a range of 3.3 to 6.9 atomic %.

In the case where the content of Mg is small, the strength may not be improved sufficiently, and the Young's modulus may not be suppressed to be a sufficiently low level. In addition, Mg is an active element. Therefore, in the case where an excess amount of Mg is contained, Mg oxides that are generated by reactions with oxygen during melting and casting may be included (may be mixed into the copper alloy). Accordingly, it is more preferable that the content of Mg is set to be in a range of 3.7 to 6.3 atomic %.

Zn is an element having an operation of improving a strength without increasing a Young's modulus when Zn is dissolved in a copper alloy in which Mg is dissolved.

In the case where the content of Zn is less than 0.1 atomic %, the effect is not obtained sufficiently. In the case where the content of Zn exceeds 10 atomic %, intermetallic compounds remain when the heat treatment for the solutionizing (solution treatment) is performed. Therefore, there is a concern that cracking occurs during a subsequent working or the like. In addition, resistance to stress corrosion cracking is lowered.

From these reasons, the content of Zn is set to be in a range of 0.1 to 10 atomic %.

Examples of the inevitable impurities include Sn, Fe, Co, Al, Ag, Mn, B, P, Ca, Sr, Ba, rare-earth elements, Zr, Hf, V, Nb, Ta, Cr, Mo, W, Re, Ru, Os, Se, Te, Rh, Ir, Pd, Pt, Au, Cd, Ga, In, Li, Si, Ge, As, Sb, Ti, Tl, Pb, Bi, S, O, C, Ni, Be, N, H, Hg, and the like.

The rare-earth element is one or more selected from a group consisting of Sc, Y, La, Ce, Pr, Nd, Pm, Sm, Eu, Gd, Tb, Dy, Ho, Er, Tm, Yb, and Lu.

It is preferable that a total content of these inevitable impurities is in a range of 0.3% by mass or less.

(Conductivity σ)

In the ternary alloy of Cu, Mg, and Zn, when the content of Mg is given as A atomic % and the content of Zn is given as B atomic %, the conductivity σ (% IACS) is within the following range.

$$\sigma \leq \{1.7241/(X+Y+1.7)\} \times 100$$

$$X = -0.0347 \times A^2 + 0.6569 \times A$$

$$Y = -0.0041 \times B^2 + 0.2503 \times B$$

In this case, the intermetallic compounds are rarely present.

That is, in the case where the conductivity σ exceeds the right side value of the above-described expression, a large amount of intermetallic compounds are present, and furthermore, the sizes thereof are large. Therefore, the bending formability is greatly deteriorated. In addition, the intermetallic compounds are generated, and an amount of dissolved Mg is small. Therefore, the Young's modulus is also increased. Accordingly, production conditions are adjusted in order for the conductivity σ to be within the range of the above-described expression.

In order to reliably obtain the above-described effects, it is preferable that the conductivity σ (% IACS) is within the following range.

$$\sigma \leq \{1.7241/(X'+Y'+1.7)\} \times 100$$

$$X' = -0.0292 \times A^2 + 0.6797 \times A$$

$$Y' = -0.0038 \times B^2 + 0.2488 \times B$$

In this case, the amount of the intermetallic compounds becomes smaller; and therefore, the bending formability is further improved.

(Microstructure)

In the copper alloy for an electronic device according to this embodiment, an average number of intermetallic compounds having grain sizes of 0.1 μm or more is in a range of $1/\mu m^2$ or less, and the average number is measured by observation using a scanning electron microscope. That is, the intermetallic compounds are rarely precipitated, and Mg and Zn are dissolved in a matrix phase.

In the case where solutionizing is incomplete or the intermetallic compounds are precipitated after the solutionizing, a large amount of intermetallic compounds having large sizes are present. These intermetallic compounds serve as a starting point of cracking. Therefore, with regard to a copper alloy in which a large amount of intermetallic compounds having large sizes are present, cracking occurs during working, or the bending formability is greatly deteriorated. In addition, in the case where the amount of the intermetallic compounds is large, the Young's modulus is increased, and thus this is unfavorable.

As a result of examining a microstructure, in the case where the average number of intermetallic compounds having grain sizes of 0.1 μm or more is in a range of $1/\mu m^2$ or less, that is, in the case where the intermetallic compounds are not present or the amount of the intermetallic compounds is small, a desirable bending formability and a low Young's modulus are obtained.

In order to reliably obtain the above-described effects, it is more preferable that an average number of intermetallic compounds having grain sizes of 0.05 μm or more is in a range of $1/\mu m^2$ or less.

The average number of the intermetallic compounds is measured by the following method. Observation of 10 visual fields is conducted using a field emission scanning electron microscope under conditions in which a magnification is 50,000-fold magnification and a visual field is approximately 4.8 $\mu m^2$, and the number (number (count)/$\mu m^2$) of intermetallic compounds in each visual field is measured. Then, the average value thereof is calculated.

The grain size of the intermetallic compound is an average value of a long diameter and a short diameter of the intermetallic compound. Here, the long diameter is the length of the longest straight line in a grain which does not come into contact with a grain boundary on the way, and the short diameter is the length of the longest straight line in a direction orthogonal to the long diameter which does not come into contact with the grain boundary on the way.

Next, a method for producing the copper alloy for an electronic device according to this embodiment, which has the above-described characteristics, will be described with reference to a flow diagram shown in FIG. 2.

(Melting and Casting Process S01)

First, a copper raw material is melted to obtain a molten copper, and the above-described elements are added to the molten copper so as to adjust components; and thereby, a molten copper alloy is produced. Here, a single element of Mg, a single element of Zn, a Cu—Mg master alloy, and the like can be used as raw materials of Mg and Zn. In addition, raw materials containing Mg and Zn may be melted together with the copper raw material. In addition, a recycled material and a scrapped material of the copper alloy of this embodiment may be used.

Here, it is preferable that the molten copper consists of copper having purity of 99.99% by mass or more, that is, so-called 4N Cu. In addition, in the melting process, in order to suppress oxidization of Mg and Zn, it is preferable to use a vacuum furnace, and it is more preferable to use an atmosphere furnace of which atmosphere is an inert gas atmosphere or a reducing atmosphere.

Then, the molten copper alloy of which the components are adjusted is casted into a mold so as to produce ingots (copper material). In the case where mass production is taken into account, it is preferable to apply a continuous casting method or a semi-continuous casting method.

(Heating Process S02)

Next, heat treatment is performed for homogenization and solutionizing (solution treatment) of the obtained ingot (copper material). During the progress of solidification, Mg and Zn segregate and concentrate; and thereby, intermetallic compounds and the like are generated. In the interior of the ingot, these intermetallic compounds and the like are present. Therefore, in order to eliminate or reduce the segregation of Mg and Zn and in order to eliminate or reduce the intermetallic compounds and the like, the ingot is subjected to the heat treatment to heat the ingot to a temperature of 500 to 900° C. Thereby, Mg and Zn are evenly dispersed, and Mg and Zn are dissolved in the matrix phase in the ingot. In addition, it is preferable that the heating process S02 is performed in a non-oxidization atmosphere or a reducing atmosphere.

(Rapid Cooling Process S03)

Then, the ingot, which is heated to a temperature of 500 to 900° C. in the heating process S02, is cooled at a cooling rate of 200° C./min or more to a temperature of 200° C. or lower. Due to this rapid cooling process S03, precipitating of Mg and Zn dissolved in a matrix phase as intermetallic compounds is suppressed. As a result, it is possible to obtain a copper alloy in which an average number of intermetallic compounds having grain sizes of 0.1 μm or more is in a range of $1/\mu m^2$ or less.

Here, in order to increase the efficiency of rough working and the uniformity of the microstructure, a hot working may be performed after the above-described heating process S02 and the above-described rapid process S03 may be performed after this hot working. In this case, a working method is not particularly limited. For example, rolling can be employed in the case where the final form is a sheet or a strip. Wire drawing, extrusion, groove rolling, or the like can be employed in the case where the final form is a line or a rod. Forging or pressing is employed in the case where the final form is a bulk shape.

(Working Process S04)

The ingot after being subjected to the heating process S02 and the rapid cooling process S03 is cut as necessary. In addition, surface milling of the ingot is performed as necessary in order to remove an oxide film or the like that is generated by the heating process S02, the rapid cooling process S03, and the like. Then, the ingot is worked (processed) in order to have a predetermined shape.

Here, the working method is not particularly limited. For example, rolling can be employed in the case where the final form is a sheet or a strip. Wire drawing, extrusion, or groove rolling can be employed in the case where the final form is a line or a rod. In addition, forging or pressing can be employed in the case where the final form is a bulk shape.

Here, a temperature condition in the working process S04 is not particularly limited; however, it is preferable to set the temperature to be in a range of −200 to 200° C. which is in a cold or warm working state. In addition, a reduction ratio is appropriately selected so as to obtain a shape close to the final form. In order to improve a strength due to work hardening, it is preferable to set the reduction ratio to be in a range of 20% or more. In addition, in order to further improve the strength, it is more preferable to set the reduction ratio to be in a range of 30% or more.

As shown in FIG. 2, the above-described heating process S02, rapid cooling process S03, and the working process S04 may be repetitively performed. Here, after one cycle is completed, the repeated heating process S02 is performed for the purpose of thoroughly conducting solutionizing (solution treatment), obtaining recrystallized structure, or softening for improvement in workability. In addition, instead of the ingot, a worked material becomes an object (copper material).

(Heat Treatment Process S05)

Next, it is preferable to subject the worked material, which is obtained by the working process S04, to a heat treatment in order to perform low-temperature anneal hardening or in order to remove residual strain. Conditions of this heat treatment are appropriately adjusted according to characteristics that are required for a product (copper alloy) to be produced.

Here, in this heat treatment process S05, it is necessary to adjust the conditions of the heat treatment (a temperature, a time, and a cooling rate) in order to suppress the precipitating of dissolved Mg. For example, this heat treatment process is preferably performed at 200° C. for approximately one minute to one hour, or at 300° C. for approximately one second to one minute. The cooling rate is preferably set to be in a range of 200° C./min or more.

In addition, the method of the heat treatment is not particularly limited; however, it is preferable to perform a heat treatment at a temperature of 100 to 500° C. for 0.1 second to 24 hours in a non-oxidization atmosphere or in a reducing atmosphere. In addition, a cooling method is not particularly limited; however, it is preferable to employ a method in which a cooling rate becomes in a range of 200° C./min or more, such as a water quenching.

Furthermore, the above-described working process S04 and heat treatment process S05 may be repetitively performed.

In this way, the copper alloy for an electronic device of this embodiment is produced. Here, in the working process S04, in the case where rolling is employed as a working method, a copper alloy for an electronic device is produced which has the final form of a sheet or strip. This copper alloy for an electronic device is called as a rolled copper alloy.

The produced copper alloy for an electronic device of this embodiment has a Young's module E of 125 GPa or less, and a 0.2% proof stress $\sigma_{0.2}$ of 400 MPa or more.

In addition, when the content of Mg is given as A atomic %, and the content of Zn is given as B atomic %, a conductivity σ (% IACS) thereof is within the following range.

$$\sigma \leq \{1.7241/(X+Y+1.7)\} \times 100$$

$$X = -0.0347 \times A^2 + 0.6569 \times A$$

$$Y = -0.0041 \times B^2 + 0.2503 \times B$$

The produced copper alloy for an electronic device of this embodiment is composed of a ternary alloy of Cu, Mg, and Zn, and the copper alloy contains Mg at a content in a range of 3.3 to 6.9 atomic % which is a solid-solution limit or more. In addition, an average number of intermetallic compounds having grain sizes of 0.1 μm or more is in a range of $1/\mu m^2$ or less.

That is, the copper alloy for an electronic device of this embodiment is composed of a Cu—Mg—Zn solid solution alloy supersaturated with Mg.

In the copper alloy composed of this Cu—Mg—Zn supersaturated solid solution, there is a tendency that a Young's modulus becomes low. Therefore, for example, in the case where the copper alloy for an electronic device of this embodiment is applied to a connector in which a male tab pushes up a spring contact portion of a female terminal and is inserted into the female terminal, or the like, a variation in a contact pressure during the insertion is suppressed. Furthermore, since an elastic limit is high, there is no concern that plastic deformation occurs easily. Therefore, the copper alloy for an electronic device of this embodiment is particularly suitable for electronic and electrical components such as terminals, connectors, relays, and the like.

In addition, since Mg is dissolved in a supersaturated manner, a large amount of coarse intermetallic compounds, which serve as a starting point of cracking during bending working, are not dispersed in the matrix phase. Therefore, bending formability is improved. As a result, it is possible to mold electronic and electrical components having a complicated shape such as terminals, connectors, relays, and the like.

Since Mg is dissolved in a supersaturated manner, a strength is improved by work hardening. Therefore, it is possible to obtain a relatively high strength.

In addition, since Zn is further dissolved in a copper alloy in which Mg is dissolved, the strength can be improved without increasing the Young's modulus.

The copper alloy is composed of a ternary alloy of Cu, Mg, and Zn, and the ternary alloy contains Cu, Mg, Zn, and inevitable impurities. Therefore, a decrease in conductivity due to other elements is suppressed; and thereby, it is possible to obtain a relatively high conductivity.

In the copper alloy for an electronic device of this embodiment, the Young's modulus E is in a range of 125 GPa or less, and the 0.2% proof stress $\sigma_{0.2}$ is in a range of 400 MPa or more. Therefore, a resilience modulus ($\sigma_{0.2}^2/2E$) becomes high. Accordingly, plastic deformation does not occur easily. As a result, the copper alloy is particularly suitable for electronic and electrical components such as terminals, connectors, relays, and the like.

According to the method for producing a copper alloy for an electronic device of this embodiment, the ingot or the worked material is composed of the ternary alloy of Cu, Mg, and Zn having the above-described composition, and the ingot or the worked material is heated to a temperature of 500 to 900° C. in the heating process S02. The solutionizing (solution treatment) of Mg and Zn can be performed by the heating process S02.

In the rapid cooling process S03, the ingot or the worked material, which is heated by the heating process S02, is cooled at a cooling rate of 200° C./min or more to a temperature of 200° C. or lower. The precipitation of intermetallic compounds during the cooling process can be suppressed due to the rapid cooling process S03. Therefore, the ingot or the worked material after the rapid cooling can be a Cu—Mg—Zn supersaturated solid solution.

In the working process S04, the rapidly cooled material (Cu—Mg—Zn supersaturated solid solution) is subjected to working. Improvement of a strength due to work hardening can be achieved by the working process S04.

In addition, in the case where the heat treatment process S05 is performed after the working process S04 in order to perform low-temperature anneal hardening or in order to remove residual strains, further improvement in mechanical characteristics can be achieved.

As described above, according to this embodiment, it is possible to provide a copper alloy for an electronic device, which has a low Young's modulus, a high proof stress, a high conductivity, and excellent bending formability, and which is suitable for electronic and electrical components such as terminals, connectors, relays, and the like.

Hereinbefore, the copper alloys for an electronic device, the methods for producing a copper alloy for an electronic device, and the rolled copper alloys for an electronic device that are embodiments of the present invention were described; however, the present invention is not limited thereto, and the present invention may be appropriately modified in a range without departing the technical features of the invention.

For example, in the above-described embodiments, an example of the method for producing the copper alloy for electronic device is described; however, the producing method is not limited to the above-described embodiments, and the copper alloy may be produced by appropriately selecting existing producing methods.

EXAMPLES

Hereinafter, a description will be made with respect to results of confirmation experiments for confirming the effects of the embodiments.

Example 1

A copper raw material composed of oxygen-free copper (ASTM B 152 C10100) having a purity of 99.99% by mass or more was prepared. This copper raw material was charged in a high purity graphite crucible, and the copper raw material was melted using a high frequency heater in an atmosphere furnace having an Ar gas atmosphere. Various elements were added to the molten copper so as to prepare component compositions shown in Table 1. Each of the resultant materials was poured into a carbon casting mold to produce an ingot. Here, the size of the ingot was set to have a thickness of approximately 20 mm×a width of approximately 20 mm×a length of approximately 100 to 120 mm. In addition, the remainder of the component composition shown in Table 1 was copper and inevitable impurities.

Each of the obtained ingots was subjected to a heating process of heating for four hours under a temperature condition described in Table 1, and then water quenching was performed.

The ingots after being subjected to the heat treatment were cut, and then surface milling was performed to remove oxide films. Then, each of the ingots was subjected to cold rolling at a reduction ratio shown in Table 1 to produce a strip material having a thickness of approximately 0.5 mm×a width of approximately 20 mm.

Each of the obtained strip materials was subjected to a heat treatment under the conditions described in Table 1 to produce a strip material for characteristic evaluation.

(Evaluation of Workability)

As an evaluation of the workability, presence or absence of cracked edges during the cold rolling was observed. Copper alloys in which no or little cracked edges were visually observed were evaluated to be A (excellent), copper alloys in which small cracked edges having lengths of less than 1 mm were caused were evaluated to be B (good), copper alloys in which cracked edges having lengths of 1 mm or more to less than 3 mm were caused were evaluated to be C (fair), copper alloys in which large cracked edges having lengths of 3 mm or more were caused were evaluated to be D (bad), and copper alloys which were broken due to cracked edges during the rolling were evaluated to be E (very bad).

Here, the length of the cracked edge refers to the length of the cracked edge from the end portion in the width direction toward the center portion in the width direction of the rolled material.

Mechanical characteristics and a conductivity were measured using each of the above-described strip material for characteristic evaluation. In addition, evaluation of bending formability and structure observation were performed.

(Mechanical Characteristics)

A test specimen of No. 13B defined by JIS Z 2201 was taken from each of the strip materials for characteristic evaluation. This test specimen was taken in a state in which the tensile direction in a tensile test was in parallel with the rolling direction of the strip material for characteristic evaluation.

A 0.2% proof stress $\sigma_{0.2}$ was measured by the offset method of JIS Z 2241.

A strain gauge was attached to the above-described test specimen, and load and extension were measured. A stress-strain curve was obtained from the measured load and extension. Then a Young's modulus E was calculated from a gradient of the obtained stress-strain curve.

(Conductivity)

A test specimen having a width of 10 mm×a length of 60 mm was taken from each of the strip materials for characteristic evaluation. The test specimen was taken in a state in which the longitudinal direction of the test specimen was in parallel with the rolling direction of the strip material for characteristic evaluation.

An electrical resistance of the test specimen was obtained by a four-terminal method. In addition, dimensions of the test specimen were measured using a micrometer, and a volume of the test specimen was calculated. Then, the conductivity was calculated from the electrical resistance and the volume that were measured.

(Bending Formability)

The bending working was performed in accordance with the test method of JBMA (Japanese Brass Makers Association, Technical Standard) T307-3. Specifically, a plurality of test specimens having a width of 10 mm×a length of 30 mm were taken from each of the strip materials for characteristic evaluation in a state in which the rolling direction was in parallel with the longitudinal direction of the test specimen. These test specimens were subjected to a W bending test using a W-type jig having a bending angle of 90° and a bending radius of 0.5 mm.

An outer periphery portion of the bent portion was confirmed with visual observation, and copper alloys which were broken were evaluated to be D (Bad), copper alloys in which only a portion was broken were evaluated to be C (Fair), copper alloys in which breakage did not occur and only minute cracking occurred were evaluated to be B (Good), and copper alloys in which breakage or fine cracking was not confirmed were evaluated to be A (Excellent).

(Observation of Microstructure)

A rolled surface of each of the specimens was subjected to mirror polishing and ion etching. Then, visual fields (approximately 120 $\mu m^2$/visual field) were observed at a 10,000-fold magnification using a FE-SEM (field emission scanning electron microscope) so as to confirm a precipitation state of intermetallic compounds.

Next, in order to examine a density (an average number) (number (count)/$\mu m^2$) of the intermetallic compounds, a visual field (approximately 120 $\mu m^2$/visual field) at a 10,000-fold magnification in which the precipitation state of the intermetallic compound was not specific was selected, and in this area, continuous 10 visual fields (approximately 4.8 $\mu m^2$/visual field) were photographed at a 50,000-fold magnification.

An average value of a long diameter and a short diameter of the intermetallic compound was utilized as a grain size of the intermetallic compound. Here, the long diameter of the intermetallic compound is the length of the longest straight line in a grain which does not come into contact with a grain boundary on the way, and the short diameter is the length of the longest straight line in a direction orthogonal to the long diameter which does not come into contact with the grain boundary on the way.

The density (average number) (number (count)/$\mu m^2$) of intermetallic compounds having grain sizes of 0.1 μm or more and the density (average number) (number (count)/$\mu m^2$) of intermetallic compounds having grain sizes of 0.05 μm or more were obtained.

Figure 3:
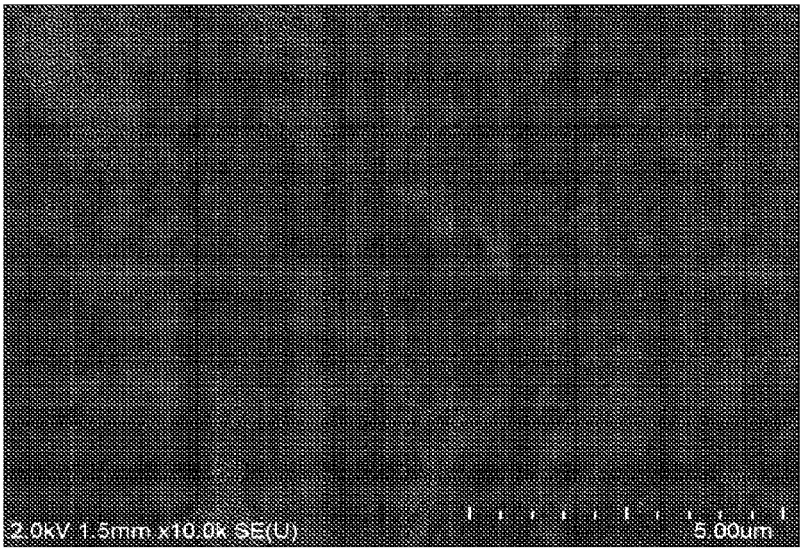
FIG. 3 shows photographs of Inventive Example 1-3 observed by a scanning electron microscope, in which (a) is a photograph at 10,000-fold magnification, and (b) is a photograph at 50,000-fold magnification.
Figure 3:
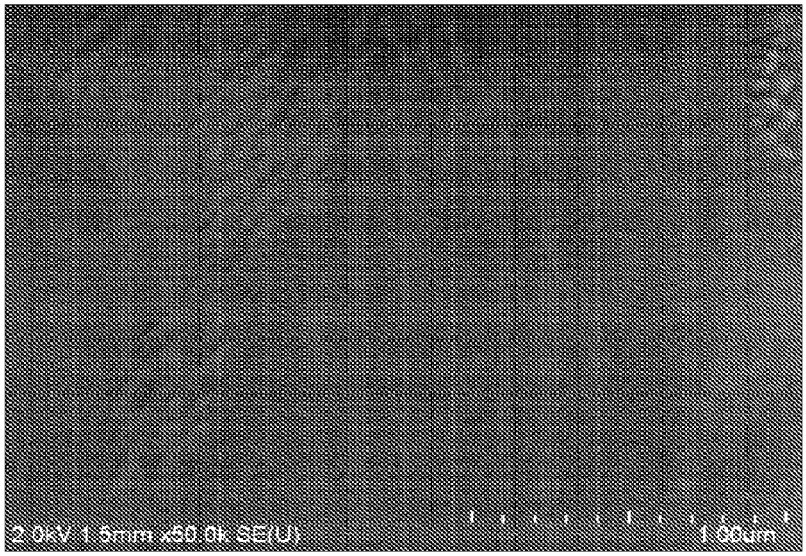
Figure 4:
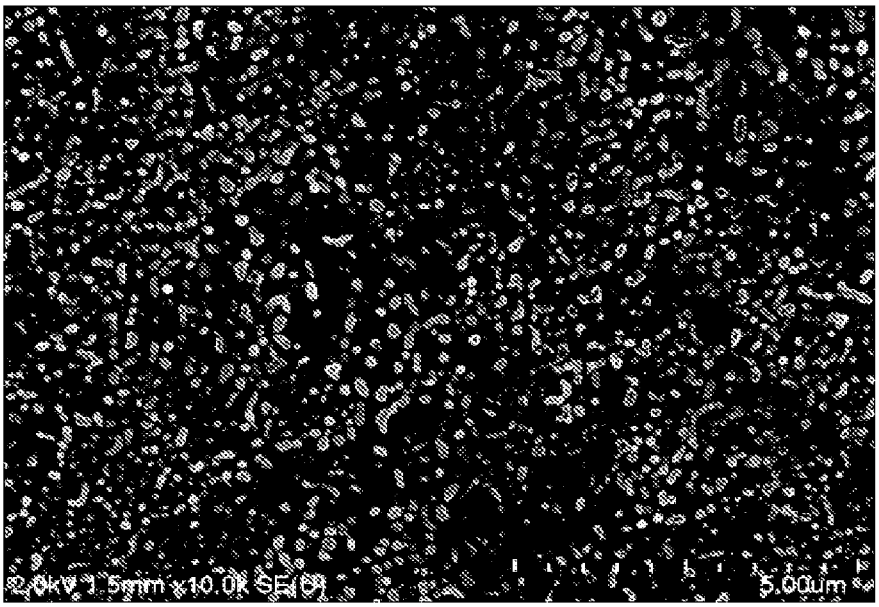
FIG. 4 shows photographs of Comparative Example 1-5 observed by a scanning electron microscope, in which (a) is a photograph at 10,000-fold magnification, and (b) is a photograph at 50,000-fold magnification.
Figure 4:
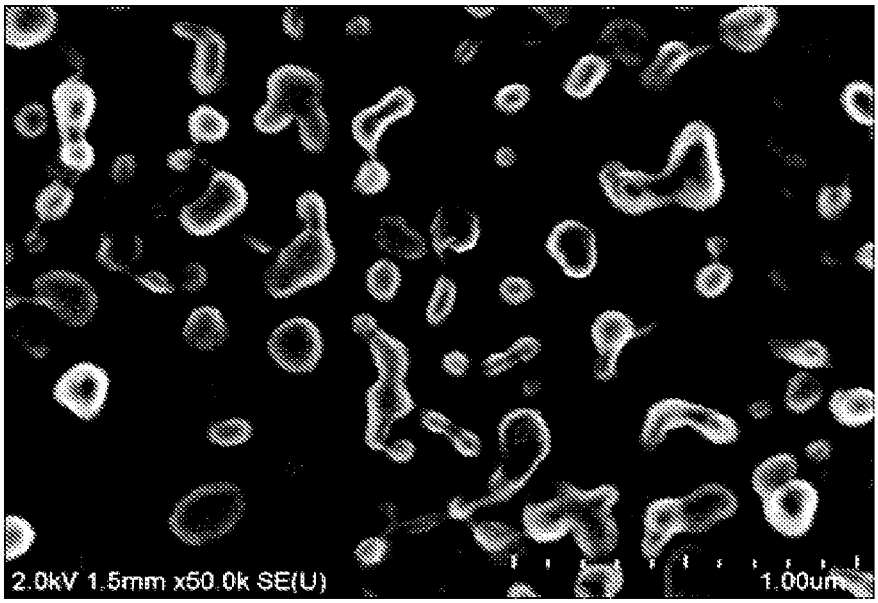

Tables 1 and 2 show producing conditions and evaluation results. In addition, as examples of the above-described observation of the microstructure, SEM observation photographs of Inventive Example 1-3 and Comparative Example 1-5 are shown in FIGS. 3 and 4, respectively.

Here, the upper limit of the conductivity described in Table 2 is a value calculated by the following expression. In the expression, A represents the content of Mg (atomic %).

$$(\text{The upper limit of conductivity})=\{1.7241/(-0.0347\times A^2+0.6569\times A+1.7)\}\times 100$$

TABLE 1

| | | Mg (at %) | Ni (at %) | Si (at %) | Zn (at %) | Sn (at %) | Temperature of heating process | Reduction ratio of working process | Conditions of heat treatment Temperature | Conditions of heat treatment Time | Cracked edge |
|---|---|---|---|---|---|---|---|---|---|---|---|
| Inventive Examples | 1-1 | 3.5 | — | — | — | — | 715° C. | 93% | 200° C. | 1 h | A |
| | 1-2 | 4.0 | — | — | — | — | 715° C. | 93% | 200° C. | 1 h | A |
| | 1-3 | 4.5 | — | — | — | — | 715° C. | 93% | 200° C. | 1 h | B |
| | 1-4 | 5.0 | — | — | — | — | 715° C. | 93% | 200° C. | 1 h | B |
| | 1-5 | 5.5 | — | — | — | — | 715° C. | 93% | 200° C. | 1 h | B |
| | 1-6 | 6.0 | — | — | — | — | 715° C. | 93% | 200° C. | 1 h | C |
| | 1-7 | 6.5 | — | — | — | — | 715° C. | 93% | 200° C. | 1 h | C |
| | 1-8 | 4.5 | — | — | — | — | 715° C. | 30% | 200° C. | 1 h | A |
| | 1-9 | 4.5 | — | — | — | — | 715° C. | 50% | 200° C. | 1 h | A |
| | 1-10 | 4.5 | — | — | — | — | 715° C. | 70% | 200° C. | 1 h | A |
| Comparative Examples | 1-1 | 1.0 | — | — | — | — | 715° C. | 93% | 200° C. | 1 h | A |
| | 1-2 | 8.0 | — | — | — | — | 715° C. | 93% | — | — | E |
| | 1-3 | 10.0 | — | — | — | — | 715° C. | 93% | — | — | E |
| | 1-4 | — | 3.0 | 1.6 | 0.5 | 0.3 | 980° C. | 93% | 400° C. | 4 h | A |
| | 1-5 | 4.5 | — | — | — | — | 715° C. | 93% | 400° C. | 1 h | B |

TABLE 2

| | | Conductivity (% IACS) | Upper limit of conductivity* | Observation of microstructure (number/μm²) 0.05 μm or more | 0.1 μm or more | 0.2% proof stress (MPa) | Young's modulus (GPa) | Bending formability |
|---|---|---|---|---|---|---|---|---|
| Inventive Examples | 1-1 | 44% | 48% | 0 | 0 | 696 | 115 | A |
| | 1-2 | 41% | 46% | 0 | 0 | 738 | 113 | A |
| | 1-3 | 38% | 44% | 0 | 0 | 731 | 111 | A |
| | 1-4 | 35% | 42% | 0 | 0 | 778 | 110 | B |
| | 1-5 | 33% | 40% | 0 | 0 | 767 | 108 | B |
| | 1-6 | 33% | 39% | 0 | 0 | 792 | 106 | B |
| | 1-7 | 31% | 38% | 0 | 0 | 826 | 104 | B |
| | 1-8 | 41% | 44% | 0 | 0 | 459 | 112 | A |
| | 1-9 | 41% | 44% | 0 | 0 | 595 | 112 | A |
| | 1-10 | 40% | 44% | 0 | 0 | 655 | 111 | A |
| Comparative Examples | 1-1 | 73% | — | 0 | 0 | 522 | 127 | A |
| | 1-2 | — | — | — | — | — | — | — |
| | 1-3 | — | — | — | — | — | — | — |
| | 1-4 | 31% | — | — | — | 758 | 131 | B |
| | 1-5 | 50% | 44% | 17 | 12 | 629 | 121 | D |

*(Upper limit of conductivity) = $\{1.7241/(-0.0347 \times A^2 + 0.6569 \times A + 1.7)\} \times 100$
A: Content of Mg (atomic %)

In Comparative Example 1-1, the content of Mg was lower than the range defined in the first embodiment, and the Young's modulus was 127 GPa which was relatively high.

In Comparative Examples 1-2 and 1-3, the contents of Mg were higher than the range defined in the first embodiment, and large cracked edges occurred during the cold rolling; and therefore, the subsequent characteristic evaluation could not be performed.

Comparative Example 1-4 is an example of a copper alloy containing Ni, Si, Zn, and Sn, that is, a so-called Corson alloy. In Comparative Example 1-4, the temperature of the heating process for solutionizing was set to 980° C., and the condition of the heat treatment was set to 400° C.×4 h so as to perform a precipitation treatment of intermetallic compounds. In Comparative Example 1-4, the occurrence of cracked edges was suppressed and precipitates were minute. Therefore, favorable bending formability was secured. However, it was confirmed that the Young's modulus was 131 GPa which was high.

In Comparative Example 1-5, the content of Mg was within the range defined in the first embodiment; however, the conductivity and the number of the intermetallic compounds were out of the ranges defined in the first embodiment. It was confirmed that the Comparative Example 1-5 was inferior in the bending formability. It is assumed that this deterioration of the bending formability is caused due to coarse intermetallic compounds which serve as a starting point of cracking.

In contrast, in all of Inventive Examples 1-1 to 1-10, the Young's moduli were in a range of 115 GPa or less which were low; and therefore, elasticity was excellent. In addition, when comparing Inventive Examples 1-3 and 1-8 to 1-10 that had the same composition and that were produced with different reduction ratios, it was confirmed that it was possible to improve the 0.2% proof stress by increasing the reduction ratio.

Example 2

Ingots were produced by the same method as Example 1 except that component compositions shown in Table 3 were prepared. Here, the remainder of the component composition shown in Table 3 was copper and inevitable impurities. In addition, strip materials for characteristic evaluation were produced by the same method as Example 1 except that a heating process, a working process, and a heat treatment process were performed under conditions described in Table 3.

Characteristics of the strip materials for characteristic evaluation were evaluated by the same method as Example 1.

Figure 5:
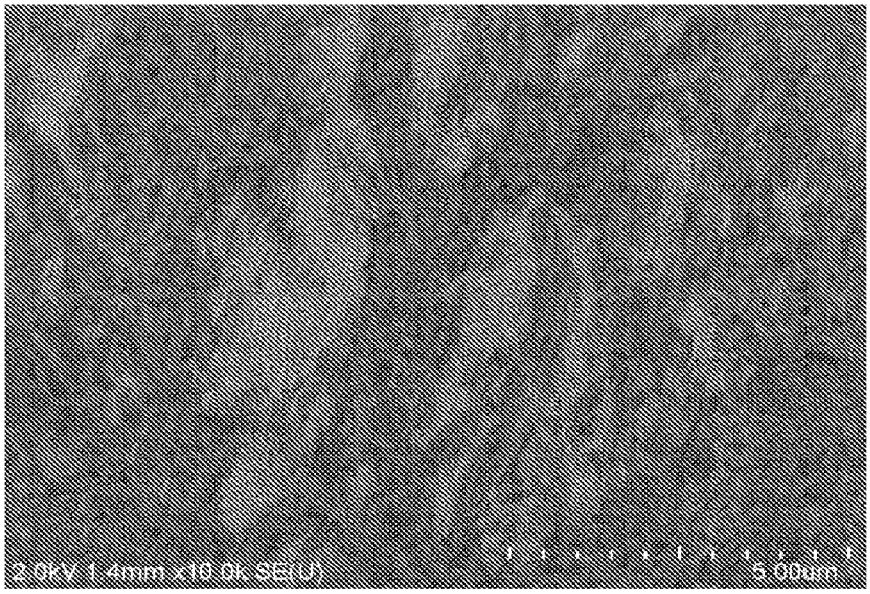
FIG. 5 shows photographs of Inventive Example 2-6 observed by a scanning electron microscope, in which (a) is a photograph at 10,000-fold magnification, and (b) is a photograph at 50,000-fold magnification.
Figure 5:
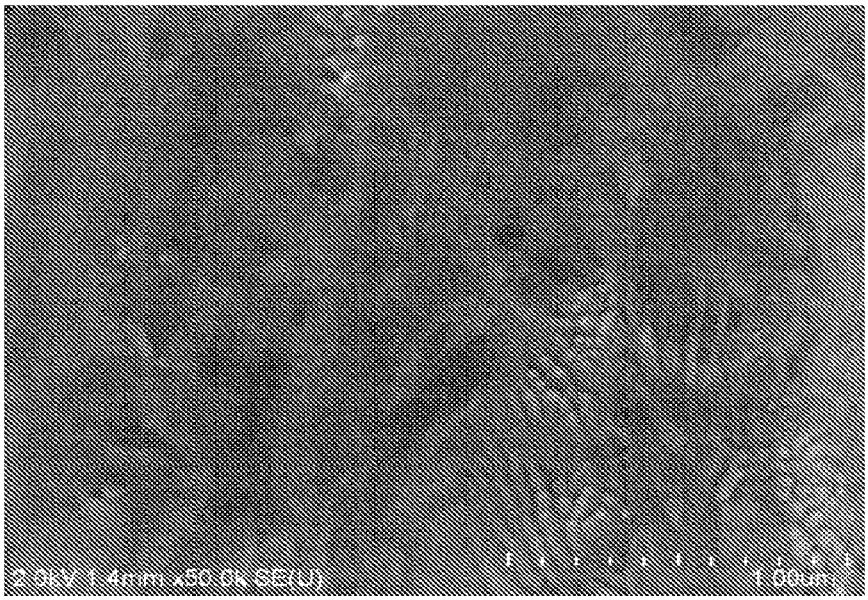
Figure 6:
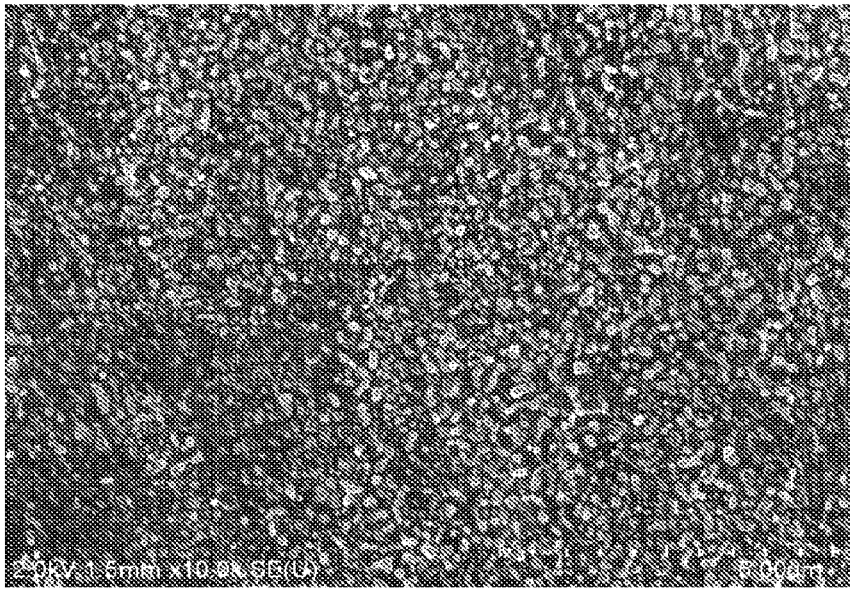
FIG. 6 shows photographs of Comparative Example 2-7 observed by a scanning electron microscope, in which (a) is a photograph at 10,000-fold magnification, and (b) is a photograph at 50,000-fold magnification.
Figure 6:
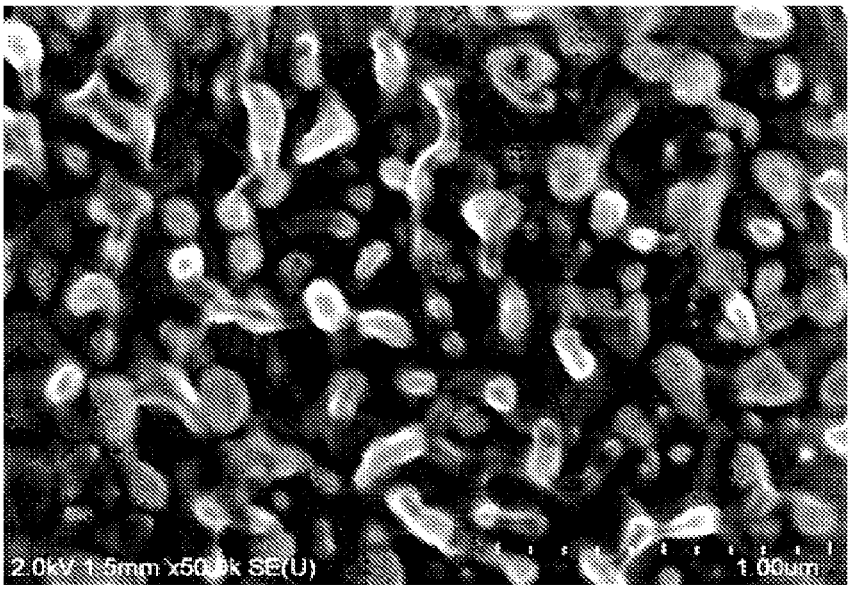

Tables 3 and 4 show producing conditions and evaluation results. In addition, as examples of the above-described observation of the microstructure, SEM observation photographs of Inventive Example 2-6 and Comparative Example 2-7 are shown in FIGS. 5 and 6, respectively.

Here, the upper limit of the conductivity described in Table 4 is a value calculated by the following expressions. In the expressions, A represents the content of Mg (atomic %), and B represents the content of Zn (atomic %).

$$\text{(The upper limit of conductivity)}=\{1.7241/(X+Y+1.7)\}\times 100$$

$$X=-0.0347\times A^2+0.6569\times A$$

$$Y=-0.0041\times B^2+0.2503\times B$$

TABLE 3

| | | Mg (at %) | Zn (at %) | Ni (at %) | Si (at %) | Sn (at %) | Temperature of heating process | Reduction ratio of working process | Conditions of heat treatment Temperature | Time | Cracked edge |
|---|---|---|---|---|---|---|---|---|---|---|---|
| Inventive Examples | 2-1 | 3.5 | 0.1 | — | — | — | 715° C. | 93% | 200° C. | 1 h | B |
| | 2-2 | 3.5 | 2.5 | — | — | — | 715° C. | 93% | 200° C. | 1 h | B |
| | 2-3 | 3.5 | 6.0 | — | — | — | 715° C. | 93% | 200° C. | 1 h | B |

TABLE 3-continued

| | | Mg (at %) | Zn (at %) | Ni (at %) | Si (at %) | Sn (at %) | Temperature of heating process | Reduction ratio of working process | Conditions of heat treatment Temperature | Conditions of heat treatment Time | Cracked edge |
|---|---|---|---|---|---|---|---|---|---|---|---|
| | 2-4 | 4.5 | 0.1 | — | — | — | 715° C. | 93% | 200° C. | 1 h | B |
| | 2-5 | 4.5 | 4.5 | — | — | — | 715° C. | 93% | 200° C. | 1 h | C |
| | 2-6 | 4.5 | 9.0 | — | — | — | 715° C. | 93% | 200° C. | 1 h | C |
| | 2-7 | 6.0 | 0.1 | — | — | — | 715° C. | 93% | 200° C. | 1 h | C |
| | 2-8 | 6.0 | 2.5 | — | — | — | 715° C. | 93% | 200° C. | 1 h | C |
| | 2-9 | 6.0 | 6.0 | — | — | — | 715° C. | 93% | 200° C. | 1 h | C |
| | 2-10 | 4.5 | 9.0 | — | — | — | 715° C. | 30% | 200° C. | 1 h | B |
| | 2-11 | 4.5 | 9.0 | — | — | — | 715° C. | 50% | 200° C. | 1 h | B |
| | 2-12 | 4.5 | 9.0 | — | — | — | 715° C. | 70% | 200° C. | 1 h | B |
| Comparative Examples | 2-1 | 1.0 | 0.0 | — | — | — | 715° C. | 93% | 200° C. | 1 h | A |
| | 2-2 | 1.0 | 2.0 | — | — | — | 715° C. | 93% | 200° C. | 1 h | B |
| | 2-3 | 3.0 | 30.0 | — | — | — | 715° C. | 93% | 200° C. | 1 h | E |
| | 2-4 | 4.5 | 20.0 | — | — | — | 715° C. | 93% | 200° C. | 1 h | E |
| | 2-5 | 6.0 | 12.0 | — | — | — | 715° C. | 93% | 200° C. | 1 h | E |
| | 2-6 | 8.0 | 0.1 | — | — | — | 715° C. | 93% | 200° C. | 1 h | E |
| | 2-7 | 4.5 | 9.0 | — | — | — | 715° C. | 93% | 400° C. | 1 h | C |
| | 2-8 | — | 0.5 | 3.0 | 1.6 | 0.3 | 980° C. | 93% | 400° C. | 4 h | A |

TABLE 4

| | | Conductivity (% IACS) | Upper limit of conductivity* | Observation of microstructure (number/μm²) 0.05 μm or more | Observation of microstructure (number/μm²) 0.1 μm or more | 0.2% proof stress (MPa) | Young's modulus (GPs) | Bending formability |
|---|---|---|---|---|---|---|---|---|
| Inventive Examples | 2-1 | 44% | 48% | 0 | 0 | 693 | 112 | A |
| | 2-2 | 39% | 41% | 0 | 0 | 724 | 110 | A |
| | 2-3 | 33% | 35% | 0 | 0 | 755 | 107 | A |
| | 2-4 | 38% | 43% | 0 | 0 | 740 | 110 | A |
| | 2-5 | 31% | 35% | 0 | 0 | 784 | 106 | A |
| | 2-6 | 26% | 29% | 0 | 0 | 825 | 106 | A |
| | 2-7 | 33% | 39% | 0 | 0 | 790 | 106 | B |
| | 2-8 | 29% | 35% | 0 | 0 | 831 | 104 | B |
| | 2-9 | 25% | 30% | 0 | 0 | 856 | 103 | B |
| | 2-10 | 28% | 29% | 0 | 0 | 528 | 109 | A |
| | 2-11 | 27% | 29% | 0 | 0 | 637 | 107 | A |
| | 2-12 | 26% | 29% | 0 | 0 | 792 | 107 | A |
| Comparative Examples | 2-1 | 73% | — | 0 | 0 | 522 | 127 | A |
| | 2-2 | 60% | — | 0 | 0 | 541 | 126 | A |
| | 2-3 | — | — | — | — | — | — | — |
| | 2-4 | — | — | — | — | — | — | — |
| | 2-5 | — | — | — | — | — | — | — |
| | 2-6 | — | — | — | — | — | — | — |
| | 2-7 | 34% | 29% | 19 | 13 | 732 | 115 | D |
| | 2-8 | 31% | — | — | — | 758 | 131 | B |

*(Upper limit of conductivity) = $\{1.7241/(X + Y + 1.7)\} \times 100$
$X = -0.0347 \times A^2 + 0.6569 \times A$, A: Content of Mg (atomic %)
$Y = -0.0041 \times B^2 + 0.2503 \times B$, B: Content of Zn (atomic %)

In Comparative Examples 2-1 and 2-2, the contents of Mg and the contents of Zn were lower than the ranges defined in the second embodiment, and the Young's moduli were 127 GPa and 126 GPa, respectively which were high.

In Comparative Examples 2-3 to 2-5, the contents of Zn were higher than the range defined in the second embodiment. In addition, in Comparative Example 2-6, the content of Mg was higher than the range defined in the second embodiment. In these Comparative Examples 2-3 to 2-6, large cracked edges occurred during the cold rolling, and the subsequent characteristic evaluation could not be performed.

In Comparative Example 2-7, the content of Mg and the content of Zn were within the ranges defined in the second embodiment; however, the conductivity and the number of the intermetallic compounds were out of the ranges defined in the second embodiment. It was confirmed that the Comparative Example 2-7 was inferior in the bending formability. It is assumed that this deterioration of the bending formability is caused due to coarse intermetallic compounds which serve as a starting point of cracking.

Comparative Example 2-8 is an example of a copper alloy containing Ni, Si, Zn, and Sn, that is, a so-called Corson alloy. In Comparative Example 2-8, the temperature of the heating process for solutionizing was set to 980° C., and the condition of the heat treatment condition was set to 400° C.×4 h so as to perform precipitation treatment of intermetallic compounds. In Comparative Example 2-8, the occurrence of cracked edges was suppressed and precipitates were minute. Therefore, favorable bending formability was secured. However, it was confirmed that the Young's modulus was 131 GPa which was high.

In contrast, in all of Inventive Examples 2-1 to 2-12, the Young's moduli were in a range of 112 GPa or less which were low; and therefore, elasticity was excellent. In addition, when comparing Inventive Examples 2-6, and 2-10 to 2-12 that had the same composition and that were produced with different reduction ratios, it was confirmed that it was possible to improve the 0.2% proof stress by increasing the reduction ratio.

From these results, it was confirmed that, according to the present invention, it is possible to provide a copper alloy for an electronic device, which has a low Young's modulus, a high proof stress, a high conductivity, and excellent bending formability and which is suitable for electronic and electrical components such as terminals, connectors, relays, and the like.

INDUSTRIAL APPLICABILITY

The copper alloys for an electronic device according to the embodiments have a low Young's modulus, a high proof stress, a high conductivity, and excellent bending formability. Therefore, the copper alloys are suitably applied to electronic and electrical components such as terminals, connectors, relays, and the like.

DESCRIPTION OF REFERENCE SIGNS

S02: Heating process
S03: Rapid cooling process
S04: Working process

The invention claimed is:

1. A copper alloy for an electronic device, wherein the copper alloy is composed of a ternary alloy of Cu, Mg, and Zn, the ternary alloy comprises Mg at a content in a range of 3.3 to 6.9 atomic % and Zn at a content in a range of 0.1 to 10 atomic %, with a remainder being Cu and inevitable impurities, a conductivity σ (% IACS) satisfies the following relation when the content of Mg is given as A atomic % and the content of Zn is given as B atomic %, $$\sigma \leq \{1.7241/(X'+Y'+1.7)\} \times 100$$

$$X' = -0.0292 \times A^2 + 0.6797 \times A$$

$$Y' = -0.0038 \times B^2 + 0.2488 \times B, \text{ and}$$

the copper alloy substantially consists of a Cu—Mg—Zn solid solution alloy supersaturated with Mg.

2. A rolled copper alloy for an electronic device, which is composed of the copper alloy for an electronic device according to claim 1, wherein a Young's modulus E is in a range of 125 GPa or less, and a 0.2% proof stress $\sigma_{0.2}$ is in a range of 400 MPa or more.

3. The rolled copper alloy for an electronic device according to claim 2, wherein the rolled copper alloy is used as a copper material that constitutes a terminal, a connector, or a relay.

* * * * *